US010301083B2

(12) United States Patent
Crawford

(10) Patent No.: US 10,301,083 B2
(45) Date of Patent: May 28, 2019

(54) POURING SPOUT AND PACKAGE INCLUDING THE SAME

(71) Applicant: COLGATE-PALMOLIVE COMPANY, New York, NY (US)

(72) Inventor: John Crawford, Mahopac, NY (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/125,467

(22) PCT Filed: Mar. 12, 2014

(86) PCT No.: PCT/US2014/024583

§ 371 (c)(1),
(2) Date: Sep. 12, 2016

(87) PCT Pub. No.: WO2015/137942

PCT Pub. Date: Sep. 17, 2015

(65) Prior Publication Data

US 2017/0073128 A1 Mar. 16, 2017

(51) Int. Cl.
*B65D 47/12* (2006.01)
*B65D 47/06* (2006.01)
(Continued)

(52) U.S. Cl.
CPC ..... *B65D 47/123* (2013.01); *B65D 1/0246* (2013.01); *B65D 23/10* (2013.01);
(Continued)

(58) Field of Classification Search
CPC ..... B05B 11/3097; B65D 1/0246; B65D 2203/12; B65D 25/2885; B65D 25/42;
(Continued)

(56) References Cited

U.S. PATENT DOCUMENTS 843,280 A * 2/1907 Kampfe ..... A47G 19/24 222/196.5
1,341,826 A 6/1920 Stewart
(Continued)

FOREIGN PATENT DOCUMENTS

EP 1144264 11/2012
GB 883 723 6/1961
(Continued)

OTHER PUBLICATIONS

International Search Report and the Written Opinion of the International Searching Authority issued in International Application PCT/US2014/024583 dated Dec. 5, 2014.

*Primary Examiner* — David P Angwin
*Assistant Examiner* — Bob Zadeh

(57) ABSTRACT

A packaged product comprising a container (100) and a scented household liquid is disclosed that comprises an integrated pouring spout (130) that is configured to increase the exposed surface area of a scented household liquid during a product dispensing event, thereby increasing the amount of scent (or fragrance) released from the scented household liquid during the product dispensing event. In one aspect, the pouring spout may have a flared section in which the width of the flow channel (147) increases moving toward the spout outlet.

19 Claims, 21 Drawing Sheets

(51) Int. Cl.

| | |
|---|---|
| ***B65D 1/02*** | (2006.01) |
| ***B65D 23/10*** | (2006.01) |
| ***B65D 25/42*** | (2006.01) |
| ***B65D 41/04*** | (2006.01) |
| ***B65D 41/26*** | (2006.01) |
| *B65D 47/04* | (2006.01) |

(52) U.S. Cl.
CPC ..... *B65D 25/42* (2013.01); *B65D 41/04* (2013.01); *B65D 41/26* (2013.01); *B65D 47/06* (2013.01); *B65D 47/043* (2013.01)

(58) Field of Classification Search
CPC ..... B65D 47/06; B65D 47/123; B65D 47/40; B65D 88/64; B65D 41/02; B65D 47/043
See application file for complete search history.

(56) References Cited

U.S. PATENT DOCUMENTS 1,844,233 A * 2/1932 Whitney ..... B65D 47/06 141/309
2,628,736 A * 2/1953 Warneke ..... B65D 47/06 220/717
2,915,223 A * 12/1959 Beall, Jr. ..... B65D 47/06 222/109
3,015,418 A * 1/1962 Hornston ..... B65D 47/10 222/108
3,198,393 A * 8/1965 Kitterman ..... B65D 47/06 222/109
3,217,935 A 11/1965 Burt
3,563,422 A * 2/1971 Cruikshank ..... B65D 47/06 222/478
3,833,150 A * 9/1974 Visser-Patings ..... B65D 47/123 222/109
4,600,131 A * 7/1986 Roof ..... B65D 47/122 222/478
4,637,530 A * 1/1987 Jiang ..... B65D 25/42 222/564
4,823,409 A 4/1989 Wahlen et al.
4,890,770 A 1/1990 Masatoshi et al.
4,981,239 A 1/1991 Cappel et al.
5,141,138 A * 8/1992 Odet ..... B65D 47/0814 215/235
5,435,467 A * 7/1995 Ekkert ..... B65D 47/122 222/109
5,597,090 A * 1/1997 Leahy ..... B65D 47/06 222/1
5,829,644 A 11/1998 Brown et al.
5,850,953 A 12/1998 Dallas, Jr.
6,375,041 B1 * 4/2002 Klima ..... B65D 51/2835 206/222
6,607,097 B2 8/2003 Carroll et al.
D520,359 S 5/2006 Sach
7,207,466 B2 * 4/2007 Walsh ..... B44D 3/12 222/109
7,407,067 B2 8/2008 Willem et al.
D663,172 S 7/2012 Huynh
D663,593 S 7/2012 Huynh
8,245,882 B1 8/2012 Federighi et al.
D676,717 S 2/2013 Ceder
D677,524 S 3/2013 Agarwal et al.
D686,076 S 7/2013 Traxler
8,556,136 B2 10/2013 Huynh
9,120,065 B2 9/2015 Santrach et al.
RE46,506 E * 8/2017 Haley
2005/0139609 A1 * 6/2005 Giblin ..... B65D 23/102 222/109
2006/0201561 A1 9/2006 Clift et al.
2007/0217718 A1 9/2007 Micnerski et al.
2013/0119059 A1 5/2013 Toh et al.
2014/0131398 A1 * 5/2014 Bardet ..... B65D 47/06 222/567
2015/0041423 A1 * 2/2015 Schmertz, Jr. ..... B65D 47/00 215/43
2017/0073115 A1 * 3/2017 Crawford ..... B65D 47/06
2017/0073128 A1 * 3/2017 Crawford ..... B65D 47/06

FOREIGN PATENT DOCUMENTS

WO WO 1998/045179 10/1998
WO WO 2011/141773 11/2011
WO 2012/146885 * 11/2012 ..... B65D 4/06
WO WO 2013/0165405 11/2013

* cited by examiner

POURING SPOUT AND PACKAGE INCLUDING THE SAME

BACKGROUND

Containers for home care liquids, such as laundry detergents and fabric softeners, having closure assemblies that include integrated pouring spouts are known. In such existing containers, the integrated pouring spouts channel the flow of the home care liquid during into a concentrated stream of the home care liquid during dispensing. As a result, the exposed surface area of the home care liquid in the pouring spout is minimized during a product dispensing event. Existing container are, thus, not optimal for dispensing scented household liquids where it may be desirable to release a perceptible scent (or fragrance) during the dispensing.

BRIEF SUMMARY

The present invention is directed to a packaged product comprising a container and a scented household liquid. The container includes an integrated pouring spout that is configured to increase the exposed surface area of a scented household liquid in the pouring spout during a product dispensing event, thereby increasing the amount of scent (or fragrance) released from the scented household liquid during the product dispensing event. In one aspect, the pouring spout may have a flared section in which the transverse width of the flow channel increases moving toward the spout outlet, thereby allowing the flow of the scented household liquid to transversely spread out to increase the exposed surface area. In another aspect, the pouring spout is designed such that at least one of the floor surface and side surfaces that define the flow channel have a topographical feature that may increase the exposed surface area of a liquid in the pouring spout and/or alter the fluid dynamics of the liquid in the pouring spout during dispensing.

In one embodiment, the invention can be a packaged product comprising: a container body forming a cavity containing a scented household liquid, the container body comprising a neck portion; a spout fitment coupled to the neck portion of the container body, the spout fitment comprising a pouring spout; the pouring spout comprising a flow channel for dispensing the scented household liquid from the cavity, the flow channel extending along a longitudinal axis from a spout inlet to a spout outlet at a distal end of the pouring spout; the flow channel comprising a flared section having a transverse width that increases with longitudinal distance from the spout inlet; and a cap detachably coupled to the container body to cover the pouring spout and seal the cavity.

In another embodiment, the invention can be a spout fitment for dispensing a liquid, the spout fitment comprising: a pouring spout, the pouring spout comprising a floor surface, a first side surface, and a second side surface that collectively define a flow channel for dispensing the liquid, the flow channel extending along a longitudinal axis from a spout inlet to a spout outlet; and at least one of the floor surface, the first side surface, and the second side surface comprising a topographical feature selected from at least one of a plurality of depressions and a plurality of protuberances.

In yet another embodiment, the invention can be a packaged product comprising: a container body forming a cavity containing the liquid, the container body comprising a neck portion; a spout fitment coupled to the neck portion of the container body, the spout fitment comprising: a pouring spout, the pouring spout comprising a floor surface, a first side surface extending upward from the floor surface, and a second side surface extending upward from the floor surface; the floor surface, the first side surface, and the second side surface collectively defining a flow channel for dispensing the scented household liquid, the flow channel extending along a longitudinal axis from a spout inlet to a spout outlet; and at least one of the floor surface, the first side surface, and the second side surface comprising a topographical feature selected from at least one of a plurality of depressions and a plurality of protuberances.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
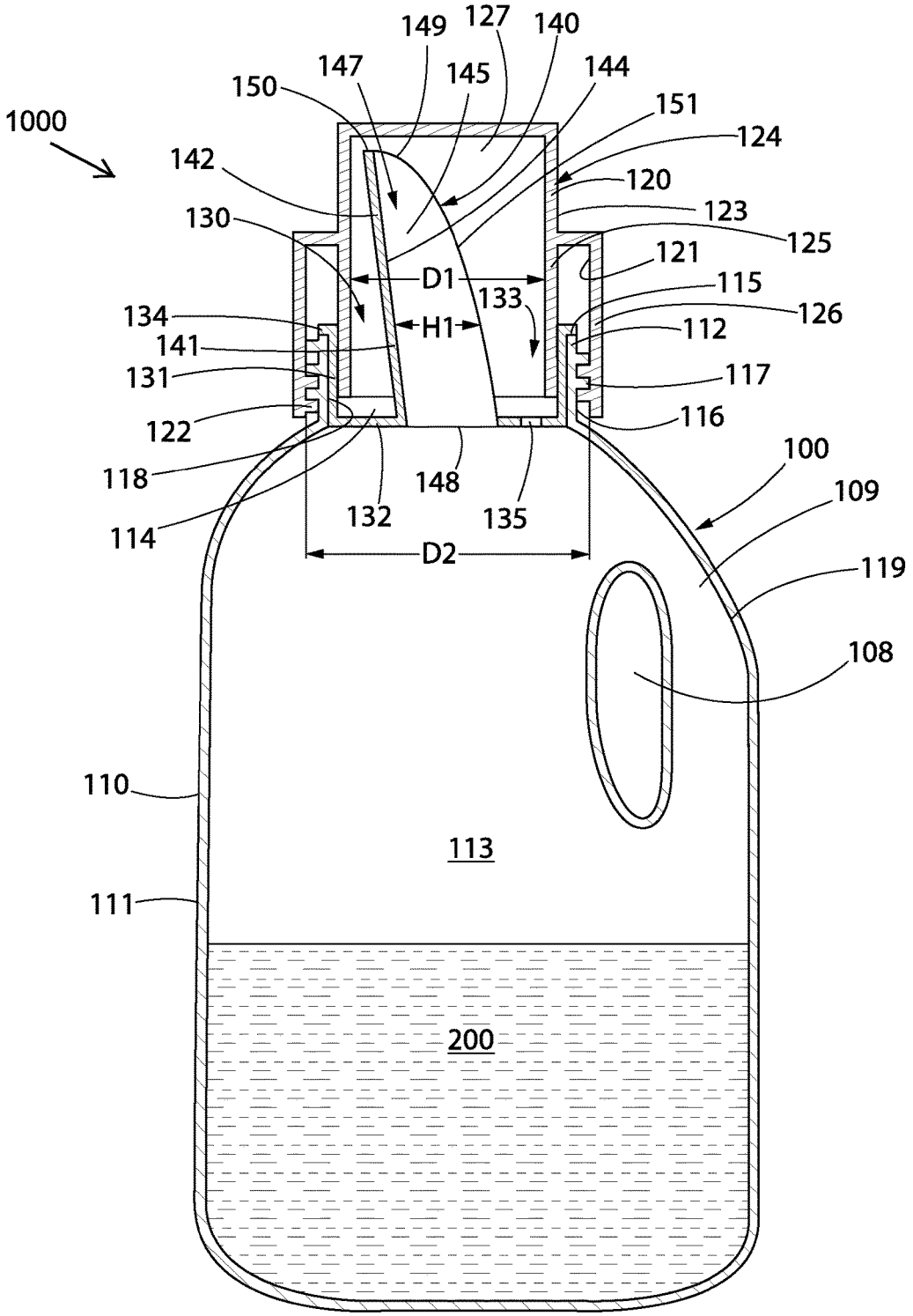
FIG. 1 is a cross-sectional schematic of a packaged product in accordance with an embodiment of the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIG. 1, a packaged product 1000 according to an embodiment of the present invention is illustrated. The packaged product 1000 generally comprises a container 100 and a liquid, which in the exemplified embodiment is a scented household liquid 200. The container 100 forms a sealed enclosure for the scented household liquid 200 that is suitable for transport, storage, and handling of the scented household liquid 200. As discussed in greater detail below, the container 100 is also configured to dispense the scented household liquid 200 in a controlled manner.

The scented household liquid 200, in certain embodiments, may be a laundry care liquid, a cleaning liquid, and an oral care liquid. Examples of suitable laundry care liquids include, without limitation, laundry detergents, stain removers, and fabric softeners. Examples of cleaning liquids include, without limitation, dish soaps, dishwashing detergents, liquid soaps, body wash and shower gels. Examples of suitable oral care liquids include, without limitation, mouthwash, oral rinsing fluids, and oral medicaments. In other embodiments, liquids other than a scented household liquid may be used with the container 100.

The container 100 generally comprises a container body 110, a cap 120, and a spout fitment 130. The container body 110 comprises a main body portion 111 and a neck portion 112. The container body 110, in the exemplified embodiment, is integrally formed as a single component. In certain other embodiments, however, the container body 110 may be a multi-component structure. The container body 110 may be formed of a plastic, for example by utilizing a blow molding or injection molding technique. Suitable plastics include, without limitation, polypropylene, polystyrene, and high and low density polyethylene. In other embodiments, the container body 110 may be formed of metal, glass, ceramic, treated cellulosic materials, or any other material that is impermeable to the scented household liquid 200 being stored therein.

The main body portion 111 of the container body 110 forms a cavity 113 for containing the scented household liquid 200. The neck portion 112 is an annular wall structure that defines a central opening 114 that forms a passageway into the cavity 113. The neck portion 112 terminates in an annular top edge 115. As will be described in greater detail below, the neck portion 112 provides the structure by which the spout fitment 130 and cap 120 can be coupled to the container body 110.

In the exemplified embodiment, the outer surface 116 of the neck portion 112 comprises threads 117 that facilitate threaded coupling between the container body 110 and the cap 120. The cap 120 comprises an inner surface 121 that comprises threads 122 that correspond to the threads 117 of the neck portion 112 for threaded mating therewith. In other embodiments, the cap 120 may be indirectly coupled to the container body 110 via the spout fitment 130 (or another structure) that is, in turn, directly or indirectly coupled to the container body 110. For example, in one such embodiment, the spout fitment 130 may comprise a skirt (not illustrated) that circumscribes the outer surface 116 of the neck portion 112 and that comprises threads on its outer surface for threaded engagement with the threads 122 of the cap 120. In another such embodiment, the cap 120 may be resized and provided with threads on its outer surface 123 for threaded engagement with threads formed on the inner surface 118 of the neck portion and/or on the annular wall 131 of the spout fitment 130. In still another embodiment, threads may be provided on the outer surface of the inner annular wall 125 of the cap 120 that engage threads formed on the inner surface 118 of the neck portion and/or on the annular wall 131 of the spout fitment 130.

The container body 110 further comprises a handle 119. The handle 119, as exemplified, is defined by a through-hole 108 that extends through the container body 110. In other embodiments, the handle 119 may be formed as a thinned portion of the container body that may include flanges for gripping. The handle 119, in the exemplified embodiment, is integrally formed with the main body portion 111. In certain other embodiments, the handle 119 may be a separate component that is coupled to the main body portion 111. The handle 119, in the exemplified embodiment, is hollow and comprises a handle cavity 109 that is in fluid communication with the cavity 113 containing the scented household liquid 200. In other embodiments, the handle 119 may be a solid structure.

The cap 120 is detachably coupled to the container body 100 so as to be capable of repetitive coupling and decoupling as necessary to dispense the scented household liquid 200. The cap 120 comprises a cup-shaped body 124 having an open bottom end and a closed top end. When coupled to the container body 120, the cap 120 covers the pouring spout 140 and seals the cavity 113, thereby preventing spilling of the scented household liquid 200 from the container 100.

In the exemplified embodiment, the cap comprises an inner annular wall 125 and an outer annular wall 126. The outer annular wall 126 circumferentially surrounds the inner annular wall 125 in a concentric manner. The cap 120 further comprises a cap cavity 127, which in the exemplified embodiment is formed by the inner annular wall 125. The cap cavity 127, in certain embodiments, may have a predetermined volume that is selected so as to correspond to a predetermined dose of the scented household liquid 200. For example, the volume of the cap cavity 17 may be selected so that it can accommodate only a single dose of the scented household liquid 200. In other embodiments, measurement indicia may be provided on the inner annular wall 125 so that precise volume measurements and/or a dose can be made.

When the cap 120 is coupled to the container body 110, the inner annular wall 125 extends into the neck portion 112. The inner annular wall 125 also allows the cap 120 to be used as an intermediate vessel for the scented household liquid 200 during a product dispensing event while at the same time protecting the threads 122 from getting coated by the scented household liquid 200, which may cause subsequent issues when recoupled to the container body 110.

When the cap 120 is coupled to the container body 110, the pouring spout 140 is located within the cap cavity 127. The cap cavity 127 has an inner diameter D1. The pouring spout 140 has a maximum width W1 (see FIG. 5). In order ensure that the cap cavity 127 can accommodate the pouring spout 140, the maximum width W1 of the pouring spout 140 is less than or equal to the inner diameter D1 of the cap 120. In other embodiments, the inner annular wall 125 may be omitted and the cap cavity 127 may be defined by the outer annular wall 126 or some other portion of the cap 120.

Moreover, the neck portion 112 of the container body 110 has an outer diameter D2. In order to ensure proper fitment of the cap 120 to the container body 110, the maximum width W1 (FIG. 5) of the pouring spout 140 is less than or equal to the outer diameter D2 of the neck portion 112.

Referring now to FIGS. 1-5, the spout fitment 130 comprises an annular wall 131, an end wall 132 extending inward from a bottom of the annular wall 131, and a pouring spout 140 extending upward from the end wall 132 so that an annular gap 133 is formed between the annular wall 132 and the pouring spout 140. The spout fitment 130 is coupled to the neck portion 112 of the container body 110. The spout fitment 130, in the exemplified embodiment, is inserted into the opening 114 defined by the neck portion 112 of the container body 110 until an upper flange 134 of the annular wall abuts the top edge 115 of the neck portion 112. The spout fitment 130 is fixed to the container body 110, for example, by a tight-fit connection between the annular wall 131 of the spout fitment 130 and the neck portion 112 of the container body 110. In other embodiments, the spout fitment 130 is fixed to the container body 110 via a mechanical interlock between the spout fitment 130 and the neck portion 112. Suitable mechanical interlocks include, without limitation, a snap-fit, a threaded engagement, a bayonet lock, and combinations thereof. In still other embodiments, the spout fitment 130 is fixed to the container body 110 by adhering the spout fitment 130 to the neck portion 112 and/or by utilizing a thermal or sonic weld. When the spout fitment 130 is coupled to the container body 110, a seal is formed between the annular wall 131 of the spout fitment 130 and the neck portion 112 of the container body 110, thereby preventing the scented household liquid 200 from escaping through the interface. The seal may be formed, without limitation, by a compressed gasket structure (which may be integrally formed into either the spout fitment 130 and/or the neck portion 112) or by the adhesive, thermal weld, or sonic weld.

The end wall 132 comprises a drain aperture 135 that forms a passageway between the annular gap 133 and the cavity 113 of the container body 110. The drain aperture 135 allows any scented household liquid 200 that may gather in the annular gap 133 during a product dispensing event to return back to the main reservoir of the scented household liquid 220 within the cavity 113 after the container 100 is returned to the upright position. The drain aperture 135 may be especially useful in embodiments of the spout fitment 130 in which the pouring spout 140 has a tubular portion adjacent the end wall 132. In certain other embodiments, the drain aperture 135 may be omitted.

The spout fitment 130, in the exemplified embodiment, is integrally formed as a single component. In certain other embodiments, however, the spout fitment 130 may be a multi-component structure. The spout fitment 130 may be formed of a plastic, for example by utilizing an injection molding or machining technique. Suitable plastics include, without limitation, polypropylene, polystyrene, and high and low density polyethylene. In other embodiments, the spout fitment 130 may be formed of metal, glass, ceramic, treated cellulosic materials or combinations thereof.

In the exemplified embodiment, the spout fitment 130 is formed as a separate component that is subsequently coupled to the container body 110 in a fixed manner. The spout fitment 130 may be coupled to the container body 110, for example, through the use of an adhesive, a friction-fit connection, a snap-fit connection, a threaded connection, a thermal weld, a sonic weld, a mechanical interference fit, or combinations thereof. In certain other embodiments, the spout fitment 130 may be coupled to 110 by way of integrally forming the spout fitment 130 and at least a portion of the container body 110 as a unitary single component.

When the spout fitment 130 is coupled to the container body 110, a first portion 141 of the pouring spout 140 is located within the neck portion 112 of the container body 110 while a second portion 142 of the pouring spout 140 protrudes beyond the top edge 115 of the neck portion 112 of the container body 110. More specifically, the first portion 141 of the pouring spout 140 is located within the central opening 114 of the neck portion 112 of the container body 110. The pouring spout 140 comprises a floor surface 144, a first side surface 145 extending upward from the floor surface 144, and a second side surface 146 extending upward from the floor surface 144. The floor surface 144, the first side surface 145, and the second side surface 146 collectively define a flow channel 147 for dispensing the scented household liquid 200 from the cavity 113. The flow channel 147 extends along a longitudinal axis A-A from a spout inlet 148 to a spout outlet 149.

The pouring spout 140 extends in a cantilevered manner beyond the top edge 115 of the neck portion 112, thereby terminating in a free distal end 150. The pouring spout 140, in the exemplified embodiment, is in the form of an open trough. In other embodiments, at least a portion of the pouring spout 140 may be in the form of a closed tubular structure. Each of the first and second side surfaces 145, 146 comprises an upper edge 151 and has a height H1 (measured from the floor surface 144 to the upper edge 151) that decreases with longitudinal distance from the spout inlet 148 (see FIG. 1). The height H1 also defines the height of the flow channel 147. In the exemplified embodiment, the upper edge 151 of each of the first and second side surfaces 145, 146 has a convexly sloped profile when viewed in side profile (see FIG. 1). In other embodiments, the upper edge 151 of each of the first and second side surfaces 145, 146 may have a stepped profile, a linearly sloped profile, a concave sloped profile, or combinations thereof (when viewed in side profile).

In the exemplified embodiment, the floor surface 144 is substantially planar and each of the first and second side surfaces 145, 146 are also substantially planar. In certain other embodiments, the floor surface 144 may be longitudinally and/or transversely contoured. Similarly, each of the first and second side surfaces 145, 146 may be longitudinally and/or transversely contoured in other embodiments. Each of the first and second side surfaces 145, 146 extend upward from the floor surface 144 in a substantially perpendicular manner. In other embodiments, each of the first and second side surfaces 145, 146 may extend upward form the floor surface 144 in an inclined manner, inclining either toward or away from the longitudinal axis A-A. In the exemplified embodiment, the longitudinal axis A-A is linear. In even further embodiments, the floor surface 144 and the first and second side surfaces 145, 146 may be continuously contoured, such that the pouring spout resembles an axial section of a hollow tube having an oval cross-section.

In certain other embodiments, the flow channel 147 may extend in a non-linear manner such that the longitudinal axis A-A is also non-linear. For example, the flow channel 147 may extend in a longitudinally curved manner such that the longitudinal axis A-A would also be longitudinally curved.

The spout inlet 148 is in fluid communication with the flow channel 147 and the cavity 113, thereby forming a passageway between the flow channel 147 and the cavity 113 so that scented household liquid 200 in the cavity 113 can be dispensed from the container 100 via the poring spout 140 (when the cap 120 is removed). The spout outlet 149 is located at, and at least partially defined by, the distal end 150 of the pouring spout 140.

Figure 5:
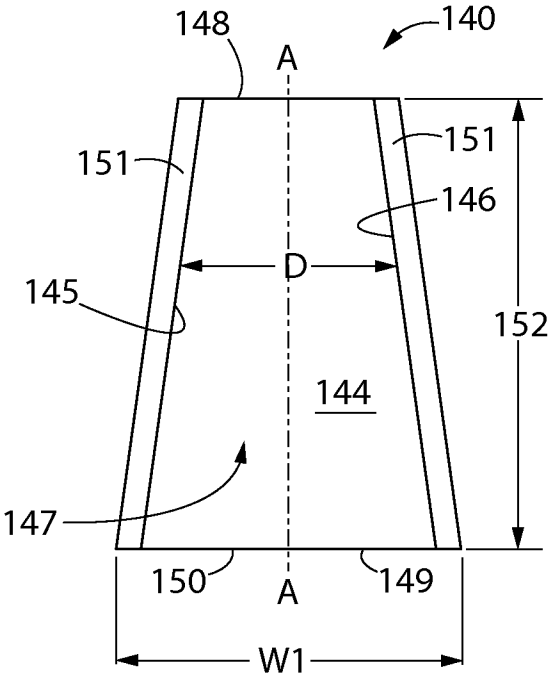
FIG. 5 is a top view of the pouring spout of the spout fitment of FIG. 3.

The first and second side surfaces 145, 146 of the pouring spout 140 are separated from one another by a distance D (measured transverse to the longitudinal axis A-A), thereby defining the transverse width of the flow channel 147 (see FIG. 5). Thus, the distance D can also be conceptually considered the transverse width of the flow channel 147 and may be referred to as such. As mentioned above, each of the first and second side surfaces 145, 146 have a height H1, thereby defining the height of the flow channel 147. Thus, at any given location along the longitudinal axis, the flow channel 147 has a height H1 and a width D which, as discussed in greater detail above and below, may vary along the longitudinal length of the flow channel 147. In one embodiment, the flow channel 147 may have a substantially rectangular transverse cross-section at the spout outlet 149 in which the width D of the flow channel 147 is greater than the height H1 of the flow channel 147. In certain embodiments, at the spout outlet 149, the width D of the flow channel 147 is at least three times greater than the height H1 of the flow channel 147.

The flow channel 147 comprises a flared section 152 in which the transverse distance D between the first and second side surfaces 145, 146 increases with longitudinal distance from the spout inlet 148. Thus, the flared section 152 widens and flattens the flow channel 147 along its length. Thus, when the scented household liquid 200 flows through the flared section 152 of the flow channel 147, the stream of the scented household liquid 200 spreads out between the first and second side surfaces 145, 146. As a result, the exposed surface area of the scented household liquid 200 is increased as the scented household liquid 200 flows through the flared section 152 of the flow channel 147, thereby increasing the amount of scent (i.e., fragrance) released during the product dispensing event.

The flared section 152 comprises the spout outlet 149. In the exemplified embodiment of FIGS. 1-5, the flared section 152 extends the entire length of the pouring spout 140 and, thus, also comprises the spout inlet 148. While the flared section 152 of the flow channel 147 extends from the spout inlet 148 to the spout outlet 149 in the embodiment of FIGS. 1-5, in certain other embodiments the flared section 152 may extend only a portion of the length of the flow channel 147. When the spout fitment 130 is coupled to the container body 110, the flared section 152 of the pouring spout 140 is at least partially located within the neck portion 112 of the container body 110. In certain other embodiments, such as where the flared section 152 forms only a portion of the flow channel 147, the flared section 152 may begin above the top edge 115 of the neck portion 112 of the container body 110.

Figure 6:
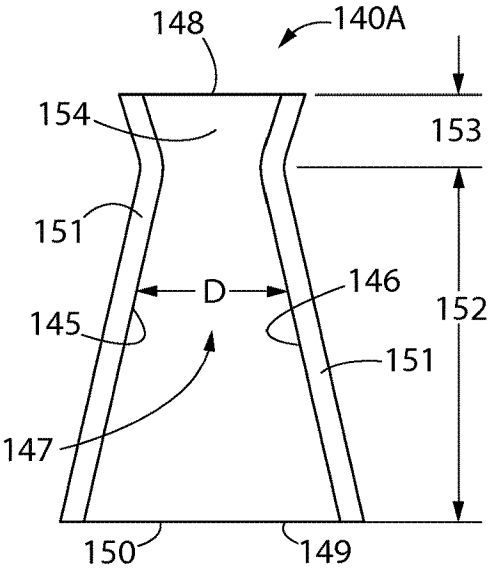
FIG. 6 is a top view of a first alternate geometry of a pouring spout that can be incorporated into the spout fitment of the container of the packaged product of FIG. 1 in accordance with a further embodiment of the present invention.

With reference to FIG. 6, in one alternate embodiment, the pouring spout 140A may be designed such that the flow channel 147 further comprises an inlet section 153 upstream of the flared section 152. In this embodiment, the inlet section 153 extends from the spout inlet 148 to a transition point 154. The flared section 152 extends from the transition point 154 to the spout outlet 149. For the inlet section 153 of the flow channel 147, the transverse distance D between the first and second side surfaces 145, 146 decreases with longitudinal distance from the spout inlet 148, thereby forming a waist portion 155 (i.e., a constriction). In other words, the inlet section 153 of the flow channel 147 has a transverse width D that decreases with distance from the spout inlet 148. In other embodiments, the inlet section 153 may have a substantially constant width D along its length. When incorporated into the spout fitment 130, which in turn is incorporated into the container 100 as described above, the scented household liquid 200 flows into the inlet section 153 via the spout inlet 148, and then flows through the flared section 152 for subsequent dispensing via the spout outlet 149. Again, as the household scented liquid 200 flows through the flared section 152 of the flow channel 147, the stream of the scented household liquid 200 spreads out between the first and second side surfaces 145, 146, thereby increasing the surface area of the scented household liquid 200 that is exposed during the product dispensing event. Moreover, in certain embodiments, the inclusion of a waist portion/constriction 155 may result in additional amounts of the surface area of the scented household liquid 200 being exposed in the flared section 152 by ensuring that some of the scented household liquid 200 flows along the first and second side surfaces 145, 146 (discussed in greater detail below).

Figure 2:
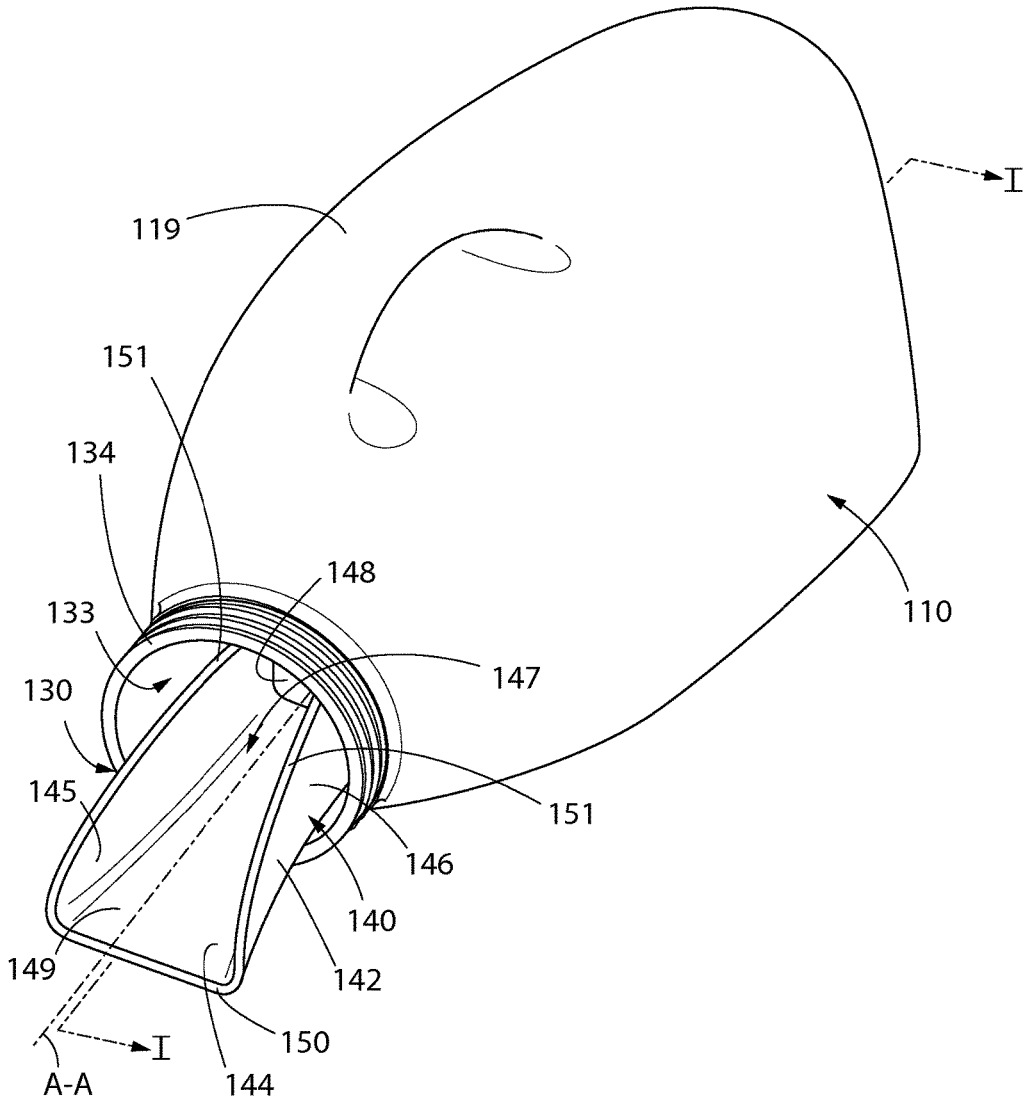
FIG. 2 is a perspective view of a top portion of the packaged product of FIG. 1, wherein the cap of the container has been removed.
Figure 2A:
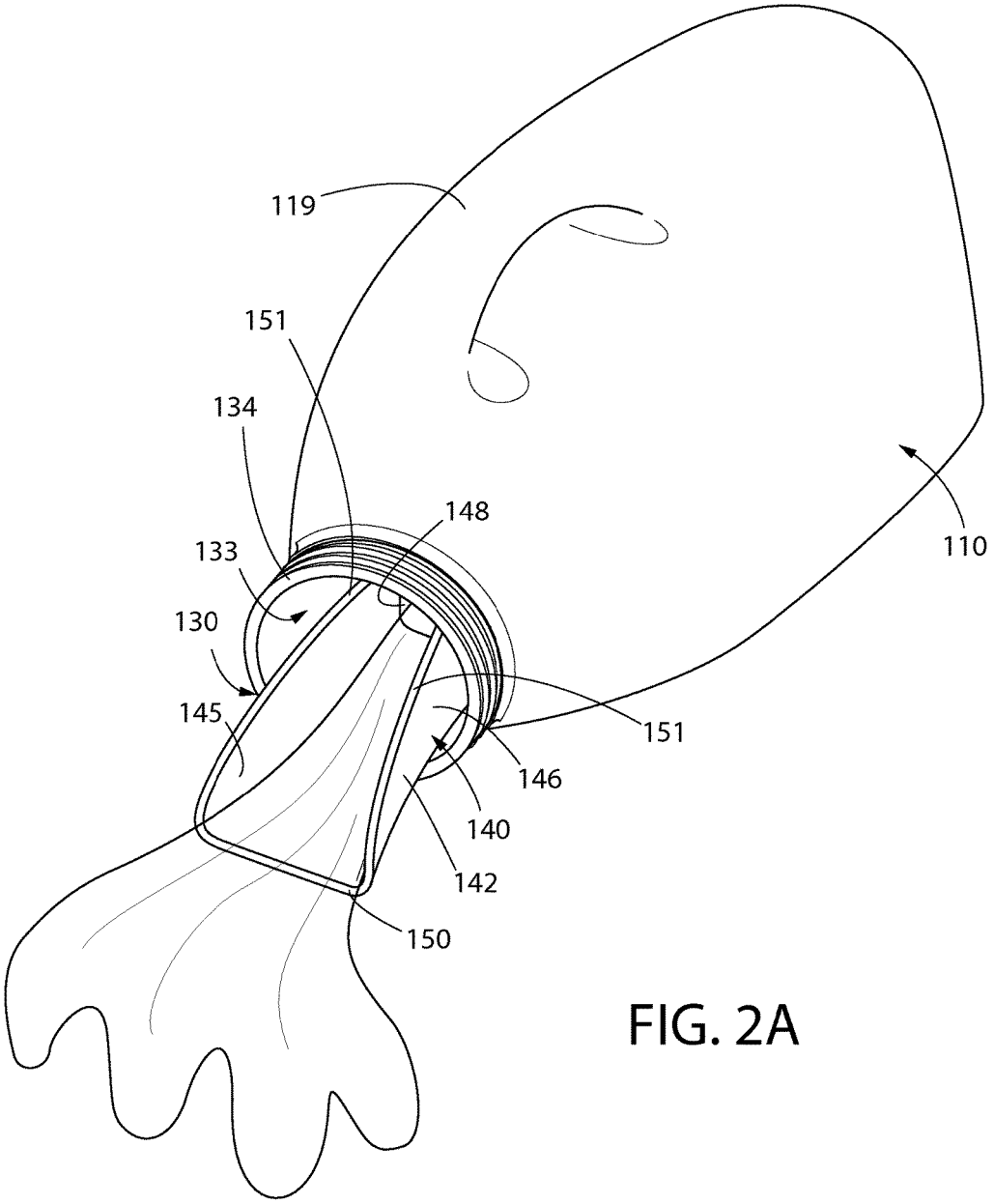
FIG. 2A is a perspective view of a top portion of the packaged product of FIG. 1, wherein the cap of the container has been removed and a scented liquid is being dispensed therefrom.
Figure 3:
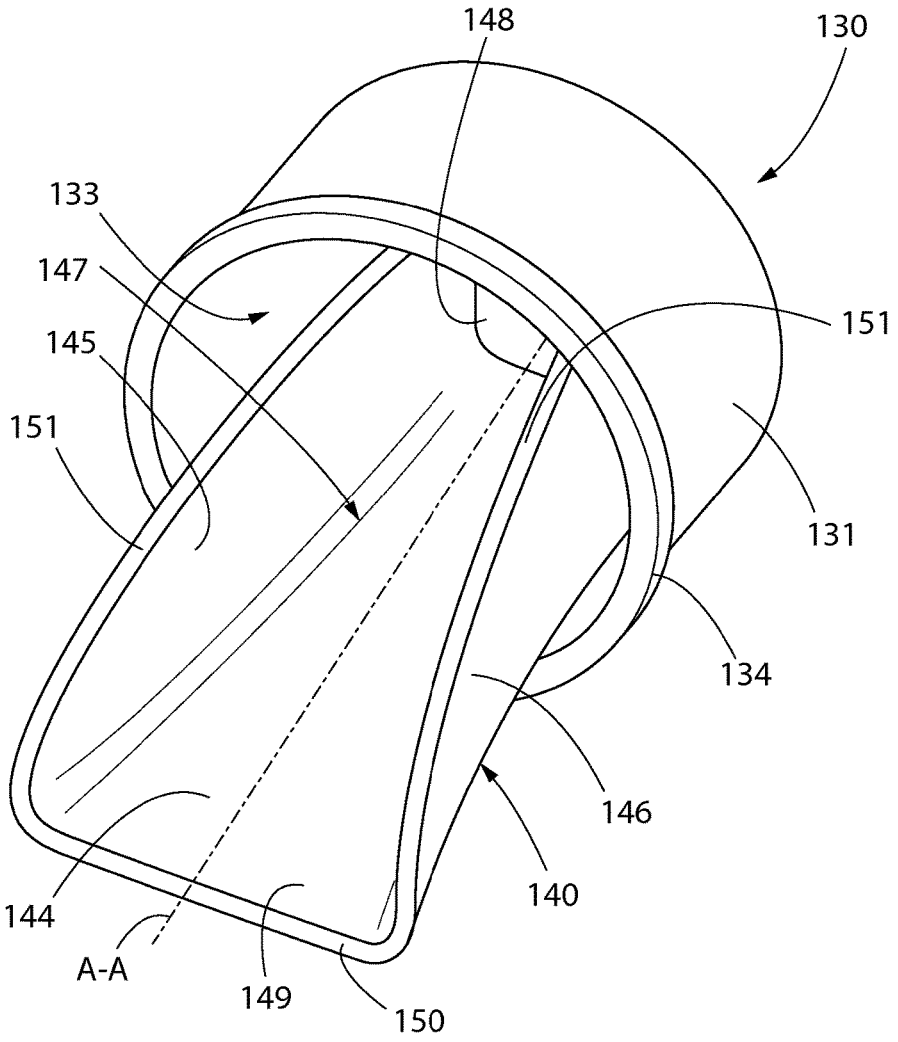
FIG. 3 is a perspective view of the spout fitment of the container of the packaged product of FIG. 1.
Figure 4:
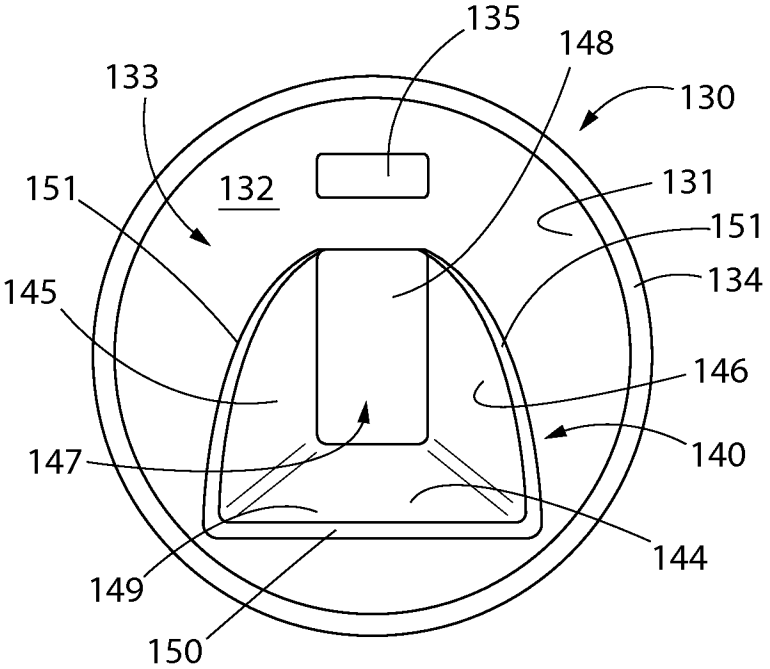
FIG. 4 is a front view of the spout fitment of FIG. 3.
Figure 8:
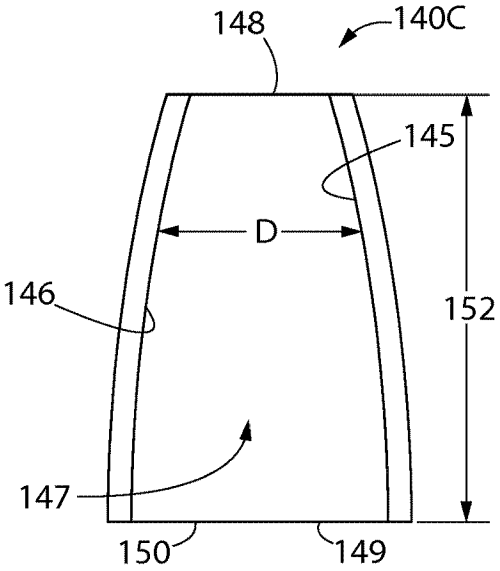
FIG. 8 is a top view of a third alternate geometry of a pouring spout that can be incorporated into the spout fitment of the container of the packaged product of FIG. 1 in accordance with a still further embodiment of the present invention.
Figure 7:
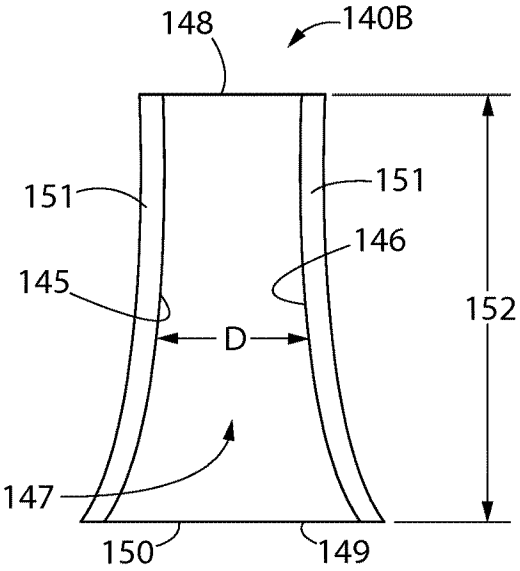
FIG. 7 is a top view of a second alternate geometry of a pouring spout that can be incorporated into the spout fitment of the container of the packaged product of FIG. 1 in accordance with a yet further embodiment of the present invention.

Referring now to FIGS. 3-5 concurrently, the transverse distance D between the first and second side surfaces 145, 146 for the flared section 152 continually increases along the entirety of the flared section 152 in a linear manner. As can be seen, each of the portions of the first and second side surfaces 145, 146 that define the flared section 152 are linear and diverge from the longitudinal axis A-A with distance from the spout inlet 148. In certain other embodiments, the flared section 152 may be formed by making one or both of the first and second side surfaces 145, 146 to have a stepped profile (when viewed from above as shown in FIGS. 3-5). In still other embodiments, such as is shown in FIG. 7, a pouring spot 140B may be designed so that the portions of each of the first and second side surfaces 145, 146 that define the flared section 152 are convexly contoured in the longitudinal direction and diverge from the longitudinal axis A-A with distance from the spout inlet 148. In still other embodiments, such as is shown in FIG. 8, a pouring spot 140C may be designed so that the portions of each of the first and second side surfaces 145, 146 that define the flared section 152 are convexly contoured in the longitudinal direction and diverge from the longitudinal axis A-A with distance from the spout inlet 148. It should be noted that the various geometries (e.g., linear, stepped, convex, concave, and combinations thereof) of the flared section 152 discussed above can be incorporated into the pouring spouts and spout fitments described in relation to FIGS. 1-6 and 9-29.

Referring now to FIGS. 9-29, various embodiments of spout fitments 130D-J are exemplified in which the pouring spouts 140J-D are provided with topographical features that may increase the exposed surface area of the scented household liquid 200 and/or alter the fluid dynamics of the scented household liquid 200 during the product dispensing event, thereby increasing the amount of scent released. In one embodiment, the topographical feature, which may be in the form of a plurality of depressions and/or a plurality of protuberances, are provided on at least one of the floor surface 144D-J, the first side surface 145D-J, or the second side surface 146D-J. In certain embodiments, each of the floor surface 144D-J, the first side surface 145D-J, and the second side surface 146D-J of the pouring spouts 140D-J may be provided with the desired configuration of the topographical feature(s).

In the embodiments discussed in greater detail below, the plurality of protuberances are exemplified as ridges while the plurality of depressions are exemplified as grooves. The invention, however, is not so limited in all embodiments. For example, in certain embodiments, the protuberances may be in the form of, without limitation, posts, conical nubs, truncated nubs, and combinations thereof. The depressions may be in the form of, without limitation, dimples, troughs, valleys, and combinations thereof. Moreover, while a few embodiments of the spout fitments 130D-J with topographical features are exemplified herein, it is to be understood that a wide variety of orientations and combinations of topographical features are envisioned.

Each of the spout fitments 130D-J can be coupled to the container body 110 of FIGS. 1-2, as discussed above for the spout fitment 130, to form a packaged product 1000 according to the present invention. Thus, it is to be understood that the above discussion of the spout fitment 130 (and its relation and incorporation into the container body 110 and the packaged product 1000) is applicable to each of the spout fitments 130D-J. Therefore, in order to avoid redundancy, only those aspects of the spout fitments 130D-J that differ from the spout fitment 130 will be described below. To this end, like structures will be identified with like reference numerals, with the exception that alphabetical suffixes "D-J" will be added. It should be noted, however, that while each of the pouring spouts 140D-J are exemplified as including a flared section 152D-J, the inclusion of the topographical features on the pouring spouts 140D-J may, in certain embodiments, constitute an aspect of the invention without the existence of a flared section. Thus, in certain embodiments, the pouring spouts 140D-J of the spout fitments 130D-J may not include a flared section as discussed above for FIG. 1-6.

Figure 9:
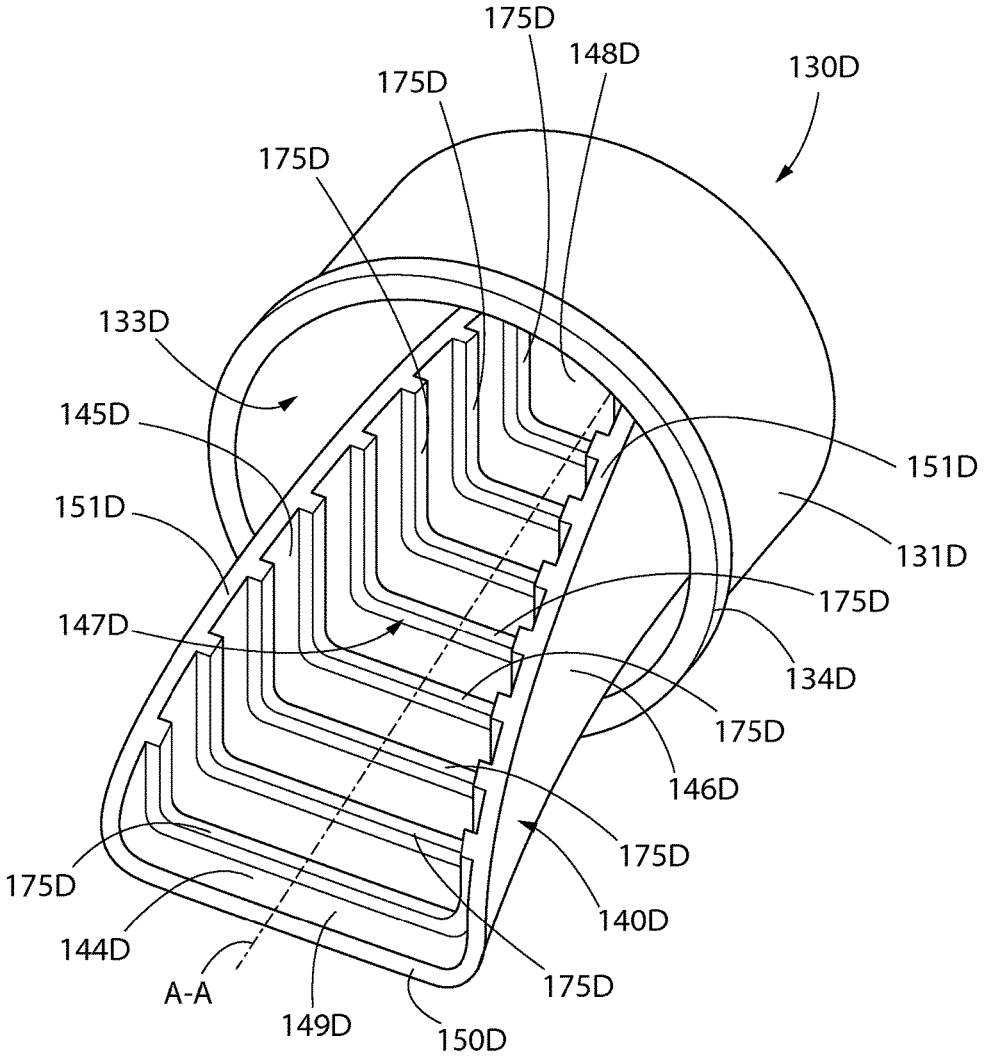
FIG. 9 is a perspective view of a first alternate embodiment of a spout fitment that can be incorporated into the container of the packaged product of FIG. 1 in accordance with the present invention, wherein the pouring spout includes a plurality of transversely extending ridges.
Figure 9A:
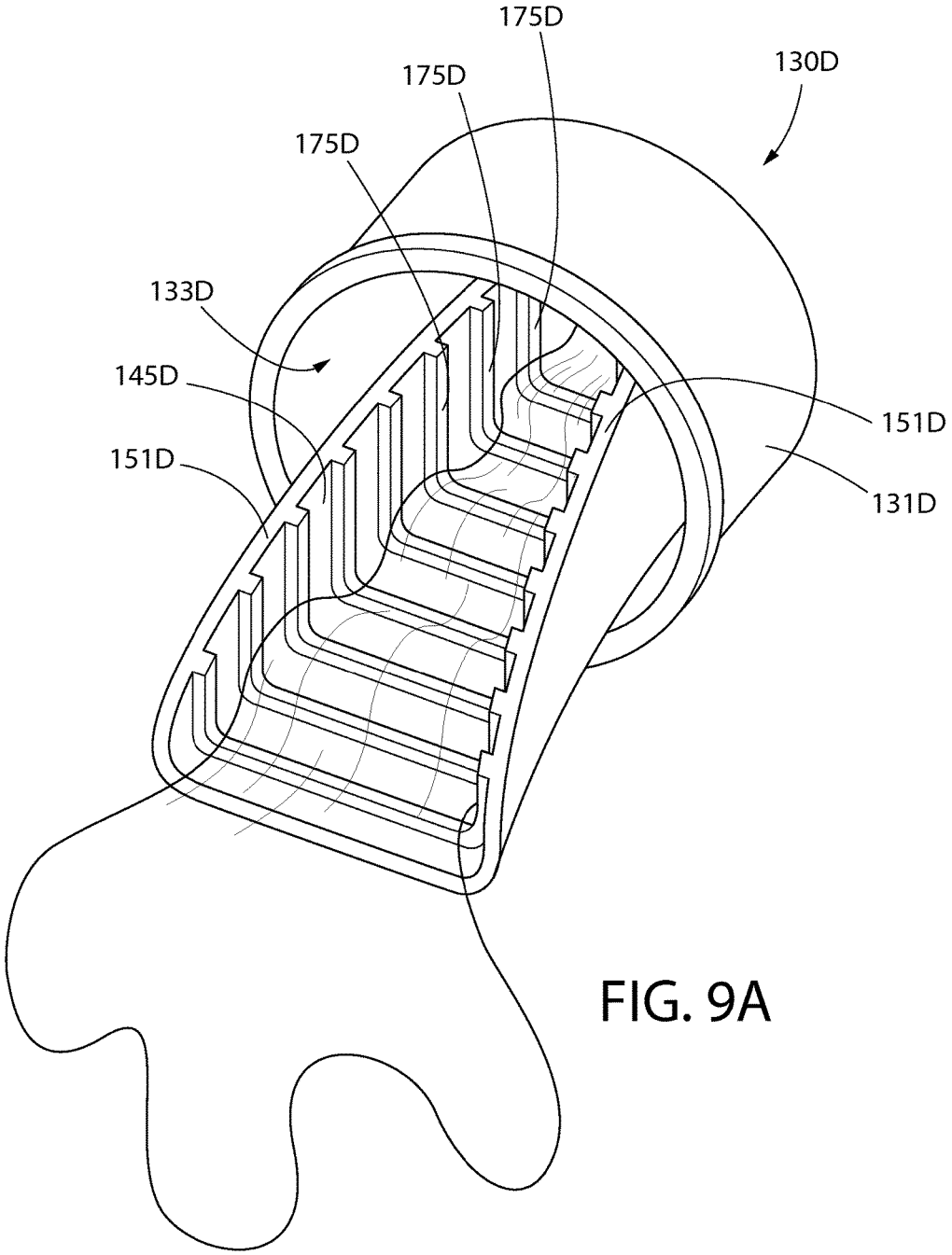
FIG. 9A is a perspective view of the first alternate embodiment of the spout fitment of FIG. 9, wherein a scented household liquid is being dispensed therefrom.
Figure 11:
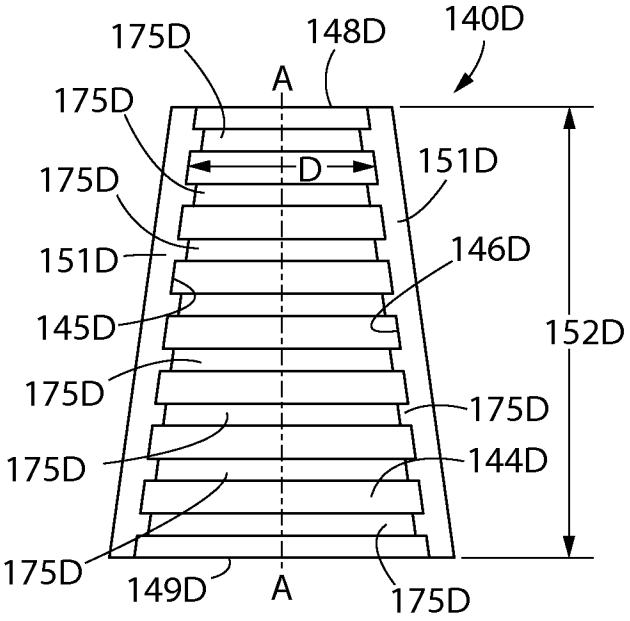
FIG. 11 is a top view of the pouring spout of the spout fitment of FIG. 9.
Figure 10:
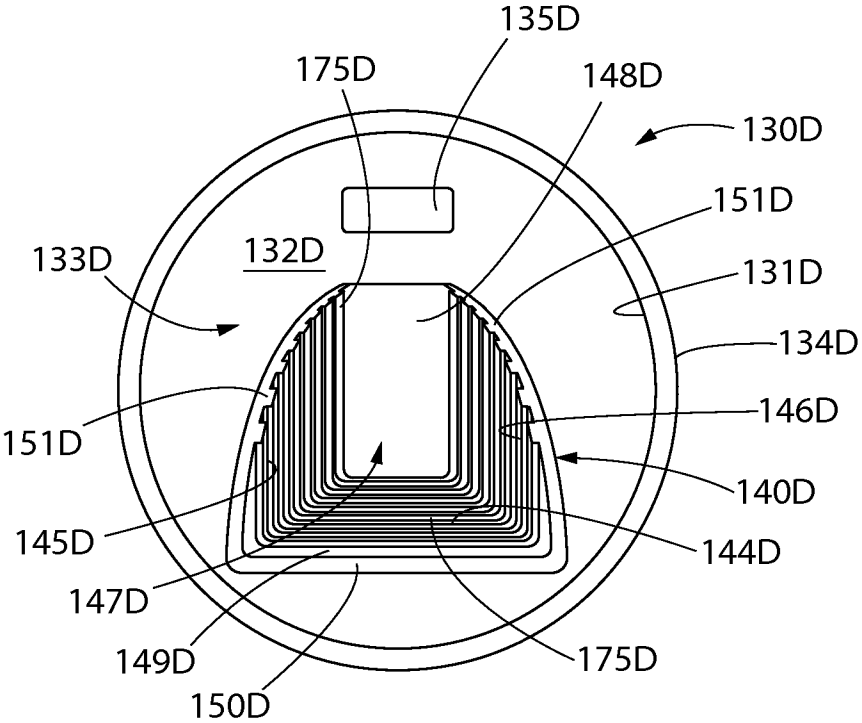
FIG. 10 is a front view of the spout fitment of FIG. 9.

Referring now to FIGS. 9-11 concurrently, a first embodiment of a spout fitment 130D that includes a pouring spout 140D including a topographical feature that may increase the amount of scent released during product dispensing is disclosed. In this embodiment, the topographical feature is in the form of a plurality of protuberances, which are in the form of a plurality of transversely extending ridges 175D. The transversely extending ridges 175D, in the exemplified embodiment, extend substantially perpendicular to the longitudinal axis A-A. In other embodiments, however, the transversely extending ridges 175D may extend obliquely to the longitudinal axis A-A.

The transversely extending ridges 175D are longitudinally spaced apart from one another along the pouring spout 140D so as to form an undulating surface. While the transversely extending ridges 175D are exemplified as having a rectangular cross-section, the transversely extending ridges 175D may have other cross-sectional shapes, such as triangular or semi-oval. In one particular embodiment, the transversely extending ridges 175D (and the spaces therebetween) may have cross-sectional shapes such that an undulating surface is formed, wherein the undulations take the form of a repetitive pattern of concave valleys and convex peaks. In one such specific embodiment, the undulations may take on a sinusoidal configuration so that the spout resembles a traditional washboard. The transversely extending ridges 175D are substantially parallel to one another in the exemplified embodiment, but may be arranged in non-parallel arrangements in other embodiments.

In the exemplified embodiment, the transversely extending ridges 175D protrude from and extend continuously across each of the floor surface 144D, the first side surface 145D, and the second side surface 146D. Thus, each of the first and second side surfaces 145D, 146D and the floor surface 144D can be considered to comprises a plurality of transversely extending ridges 175D that protrude into the flow channel 147D. In other embodiments, the plurality of transversely extending ridges 175D may be omitted from the first and second side surfaces 145D, 146D such that only the floor surface 144D may comprise the plurality of transversely extending ridges 175D, and vice versa.

The transversely extending ridges 175D are exemplified in the form of elongated ribs. In other embodiments, the transversely extending ridges 175D may be in the form successive steps formed into the pouring spout 140D. Additionally, while the transversely extending ridges 175D are exemplified as continuous structures, the transversely extending ridges 175D may be segmented in other embodiments. In such embodiments, each segment of a transversely extending ridge 175D may be considered, and referred to as, a transversely extending ridge. The transversely extending ridges 175D are linear in the exemplified embodiment but may be nonlinear in other embodiments, such as curved, either convex and/or concave.

During a product dispensing event in which the spout fitment 130D is incorporated into the packaged product 1000, the transversely extending ridges 175D may cause waves or other irregularities and/or turbulences in the stream of the scented household product 200 flowing through the flow channel 147. As a result, an increased amount of scent may be released from the scented household product 200 during the product dispensing event.

Figure 12:
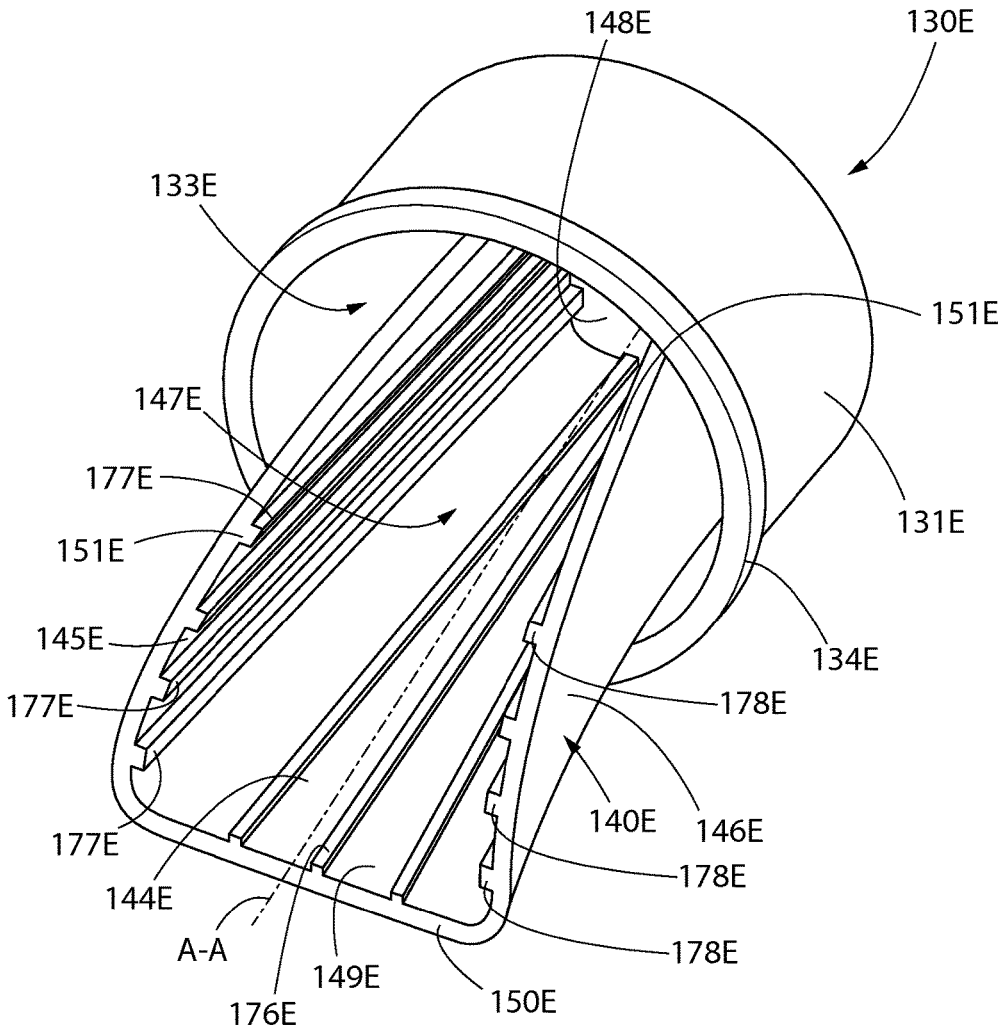
FIG. 12 is a perspective view of a second alternate embodiment of a spout fitment that can be incorporated into the container of the packaged product of FIG. 1 in accordance with the present invention, wherein the pouring spout includes a plurality of longitudinally extending ridges.
Figure 14:
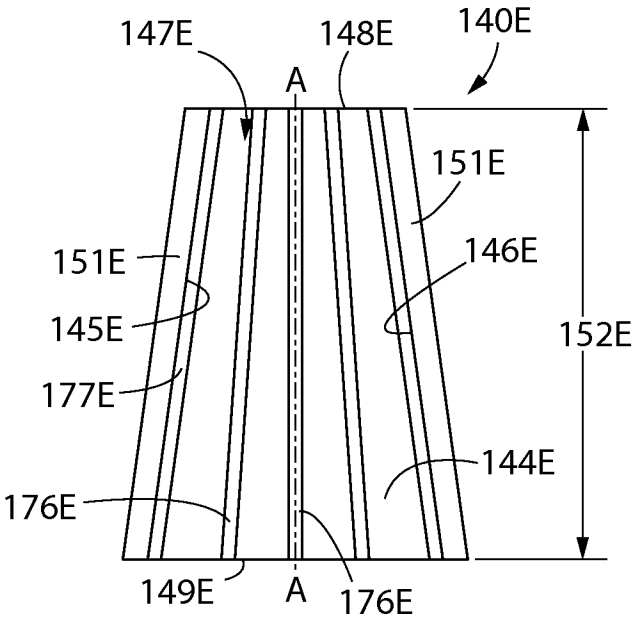
FIG. 14 is a top view of the pouring spout of the spout fitment of FIG. 12.
Figure 13:
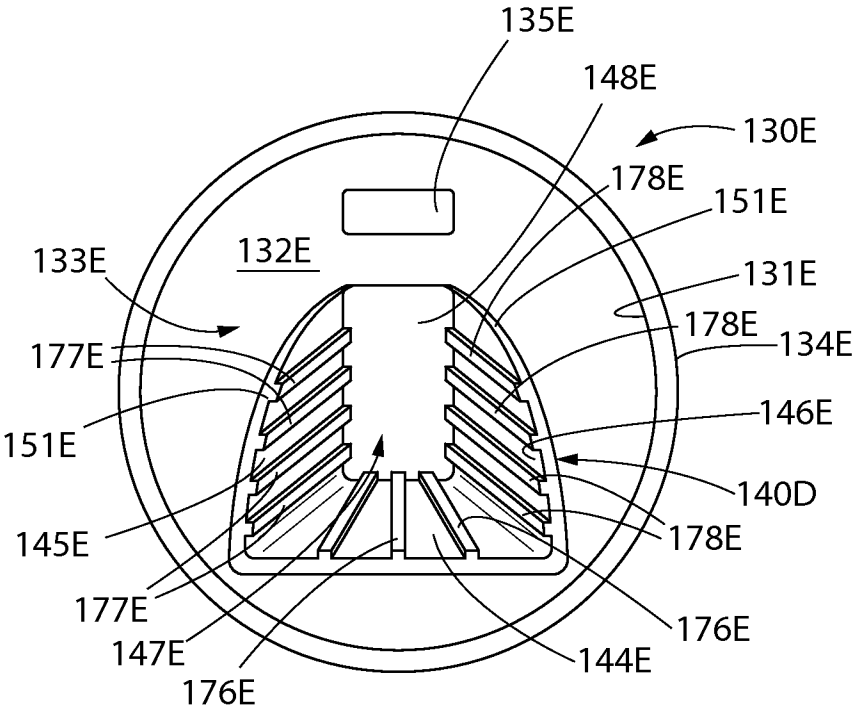
FIG. 13 is a front view of the spout fitment of FIG. 12.

Referring now to FIGS. 12-14 concurrently, a second embodiment of a spout fitment 130E that includes a pouring spout 140E including a topographical feature that may increase the amount of scent released during product dispensing is disclosed. In this embodiment, the topographical feature is in the form of a plurality of protuberances, which are in the form of a plurality of longitudinally extending ridges 176E, 177E, 178E. In the exemplified embodiment, each of the plurality of longitudinally extending ridges 176E, 177E, 178E extend the entire length of the pouring spout 140E from the spout inlet 148E to the spout outlet 149E. In certain embodiments, one or more of the plurality of longitudinally extending ridges 176E, 177E, 178E may extend less than the entire length of the pouring spout 140E. The longitudinally extending ridges 176E, 177E, 178E are transversely spaced apart from one another.

The plurality of longitudinally extending ridges 176E are located along and protrude from the floor surface 144E of the pouring spout 140E into the flow channel 147E. The plurality of longitudinally extending ridges 176E are transversely spaced from another. While the plurality of longitudinally extending ridges 176E are exemplified as having a rectangular cross-section, the plurality of longitudinally extending ridges 176E may have other cross-sectional shapes, such as triangular or semi-oval. In one particular embodiment, plurality of longitudinally extending ridges 176E (and the spaces therebetween) may have cross-sectional shapes such that an undulating surface is formed, wherein the undulations take the form of a repetitive pattern of concave valleys and convex peaks. In one such specific embodiment, the undulations may take on a sinusoidal configuration.

The plurality of longitudinally extending ridges 176E diverge from one another with longitudinal distance from the spout inlet 148E. More specifically, the plurality of longitudinally extending ridges 176E diverge from one another along the flared section 152E of the flow channel 147. Thus, the plurality of longitudinally extending ridges 176E may not only assist with creating waves and/or irregularities in the stream of the scented household liquid 200 during a product dispensing event, but may also assist with spreading/widening the stream of the scented household liquid 200 as it flows through the flared section 152E, thereby ensuring an increase in the exposed surface area of the scented household liquid 200. The plurality of longitudinally extending ridges 176E may also assist with separating the product flow into isolated streams and preventing surface tension of the scented household liquid 200 from causing the product flow to converge.

In certain embodiments, the plurality of longitudinally extending ridges 176E may be arranged symmetrically about the longitudinal axis A-A so as to intersect each other along the longitudinal axis A-A to form consecutively nesting V-shaped ridges. In other embodiments, however, the plurality of longitudinally extending ridges 176E may extend substantially parallel to one another and/or substantially parallel to the longitudinal axis A-A.

The plurality of longitudinally extending ridges 177E are located along and protrude from the first side surface 145E of the pouring spout 140E into the flow channel 147E. The plurality of longitudinally extending ridges 177E extend substantially parallel to one another in the exemplified embodiment, but may extend non-parallel to one another in other embodiments. The plurality of longitudinally extending ridges 178E are located along and protrude from the second side surface 146E of the pouring spout 140E into the flow channel 147E. The plurality of longitudinally extending ridges 178E extend substantially parallel to one another in the exemplified embodiment, but may extend non-parallel to one another in other embodiments.

The plurality of longitudinally extending ridges 177E, 178E may further assist with increasing the amount of scent released from the scented household liquid 200 during a product dispensing event by directing and maintaining a portion of the flow of the scented household liquid 200 along the first and second side surfaces 145E, 146E. As a result, the scented household liquid 200 may coat the floor surface 144E, the first side surface 145E, and the second side surface 146E during a product dispensing event. The existence of the plurality of longitudinally extending ridges 177E, 178E along the first and second side surfaces 145E, 146E may be particularly useful in embodiments in which the plurality of longitudinally extending ridges 177E, 178E are located along a flared section 152E of the flow channel 147E. In such an embodiment, because the width D of the flow channel 147E is narrowed at the entry point of the flared section 152E (compared to the remainder of the flared section 152E), the depth of the stream of the scented household product 200 will be elevated at the entry point, allowing the scented household product 200 to ride up along the first and second side surfaces 145E, 146E. As the scented household product 200 flows down the flared section 152E, it widens out and becomes shallower. However, some of the scented household product 200 that rode up along the first and second side surfaces 145E, 146E at the entry point will be carried down the first and second side surfaces 145E, 146E pouring spout 140E along the plurality of longitudinally extending ridges 177E, 178E.

In the exemplified embodiments, each of the floor surface 144E, the first side surface 145E, and the second side surface 146E comprise the longitudinally extending ridges 176E, 177E, 178E. In other embodiments, the plurality of longitudinally extending ridges 177E, 178E may be omitted from the first and second side surfaces 145E, 146E such that only the floor surface 144E may comprise the plurality of longitudinally extending ridges 176E. In other embodiments, the plurality of longitudinally extending ridges 176E may be omitted from the floor surface 144E such that only the first and second side surfaces 145E, 146E comprise the plurality of longitudinally extending ridges 177E, 178E.

The longitudinally extending ridges 176E, 177E, 178E are exemplified in the form of elongated ribs. In other embodiments, the transversely extending ridges 175D may be in the form of steps formed into the pouring spout 140E. Additionally, while the longitudinally extending ridges 176E, 177E, 178E are exemplified as continuous structures, the longitudinally extending ridges 176E, 177E, 178E may be segmented in other embodiments. In such embodiments, a segment of the longitudinally extending ridges 176E, 177E, 178E may be considered and referred to as a longitudinally extending ridge in of itself.

Figure 15:
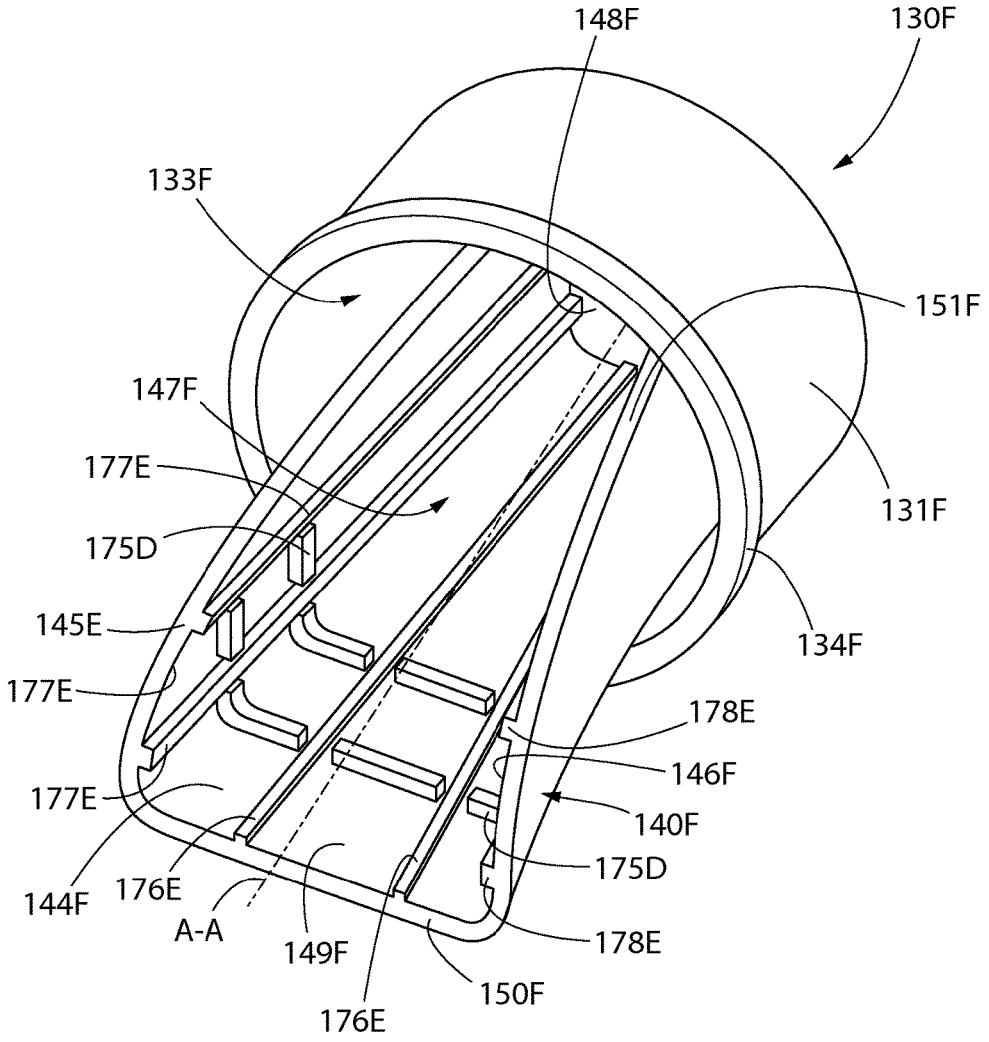
FIG. 15 is a perspective view of a third alternate embodiment of a spout fitment that can be incorporated into the container of the packaged product of FIG. 1 in accordance with the present invention, wherein the pouring spout includes a plurality of longitudinally extending ridges and a plurality of transversely extending ridges.
Figure 17:
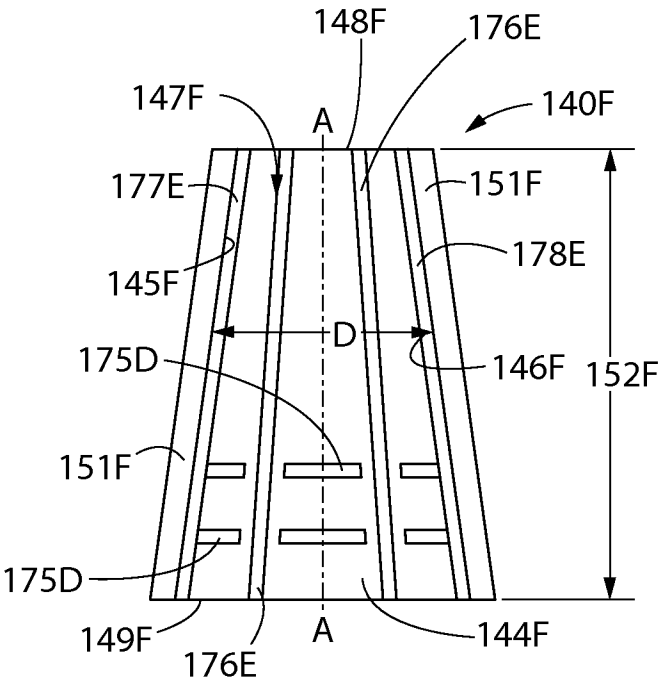
FIG. 17 is a top view of the pouring spout of the spout fitment of FIG. 15.
Figure 16:
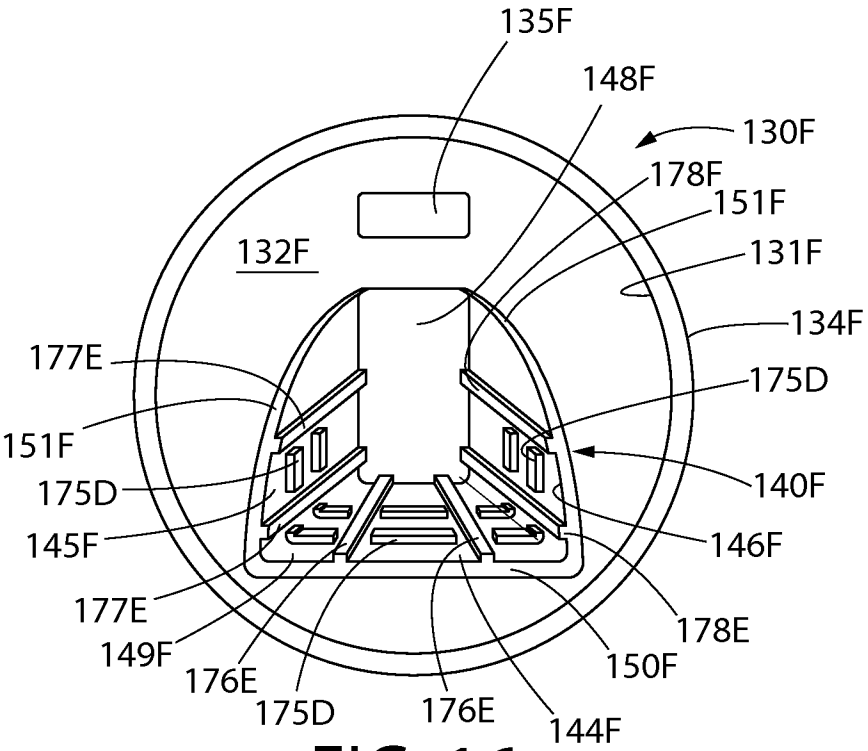
FIG. 16 is a front view of the spout fitment of FIG. 15.

Referring now to FIGS. 15-17 concurrently, a third embodiment of a spout fitment 130F that includes a pouring spout 140F having a topographical feature that may increase the amount of scent released during product dispensing is disclosed. In this embodiment, the topographical feature is in the form of a plurality of protuberances, which include a combination of the plurality of transversely extending ridges 175D (discussed above in relation to FIGS. 9-11) and the plurality of longitudinally extending ridges 176E, 177E, 178E (discussed above in relation to FIGS. 12-14). It is to be understood that the above discussions regarding the details of the plurality of transversely extending ridges 175D and the plurality of longitudinally extending ridges 176E, 177E, 178E are applicable to the exemplified embodiment of FIGS. 15-17.

The pouring spout 140F of the spout fitment 130F comprises both the plurality of transversely extending ridges 175D, which are in segmented form, and the plurality of longitudinally extending ridges 176E, 177E, 178E. Thus, the floor surface 144F comprises both the plurality of longitudinally extending ridges 176E and segments of the plurality of transversely extending ridges 175D (which can be considered transversely extending ridges). The first side surface 145F comprises both the plurality of longitudinally extending ridges 177E and segments of the plurality of transversely extending ridges 175D (which can be considered transversely extending ridges). The second side surface 146F comprises both the plurality of longitudinally extending ridges 178E and segments of the plurality of transversely extending ridges 175D (which can be considered transversely extending ridges).

The plurality of transversely extending ridges 175D are segmented such that the plurality of transversely extending ridges 175D do not intersect with any of the plurality of longitudinally extending ridges 176E, 177E, 178E. Rather, the plurality of transversely extending ridges 175D and the plurality of longitudinally extending ridges 176E, 177E, 178E form a non-intersecting grid arrangement. In certain other embodiments, the plurality of transversely extending ridges 175D may intersect with the plurality of longitudinally extending ridges 176E, 177E, 178E to form an intersecting grid arrangement.

Figure 18:
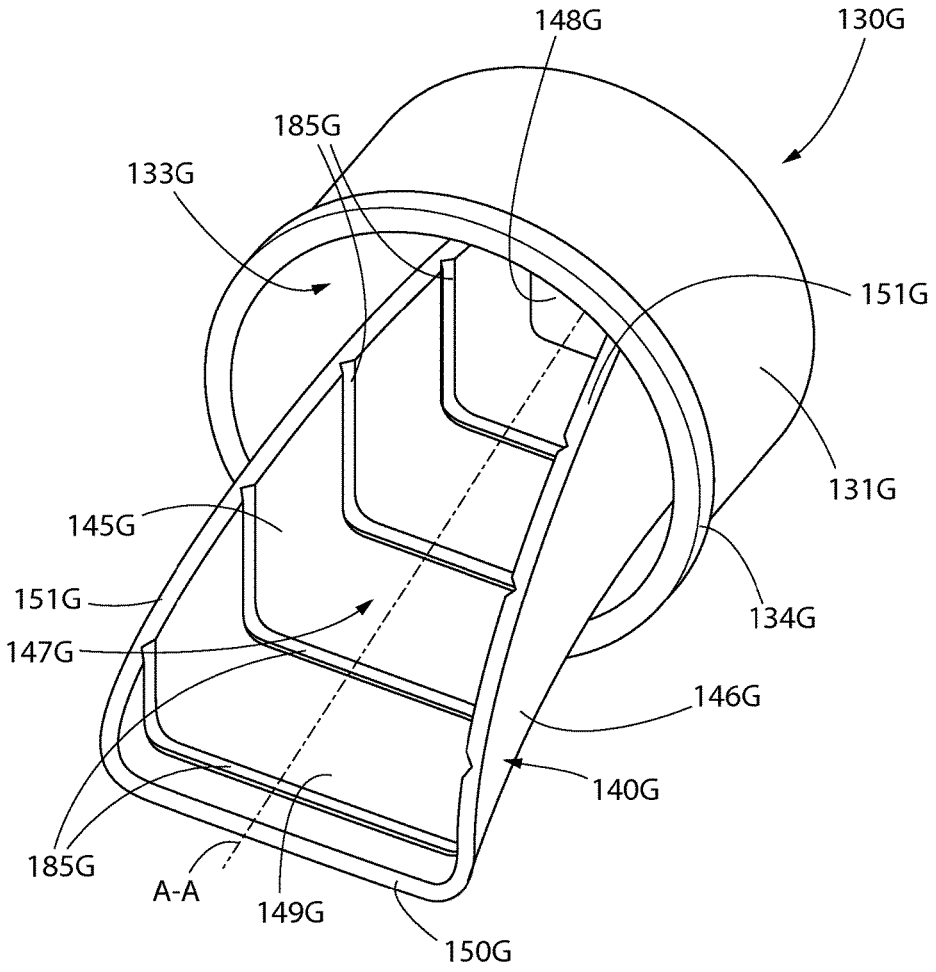
FIG. 18 is a perspective view of a fourth alternate embodiment of a spout fitment that can be incorporated into the container of the packaged product of FIG. 1 in accordance with the present invention, wherein the pouring spout includes a plurality of transversely extending grooves.
Figure 20:
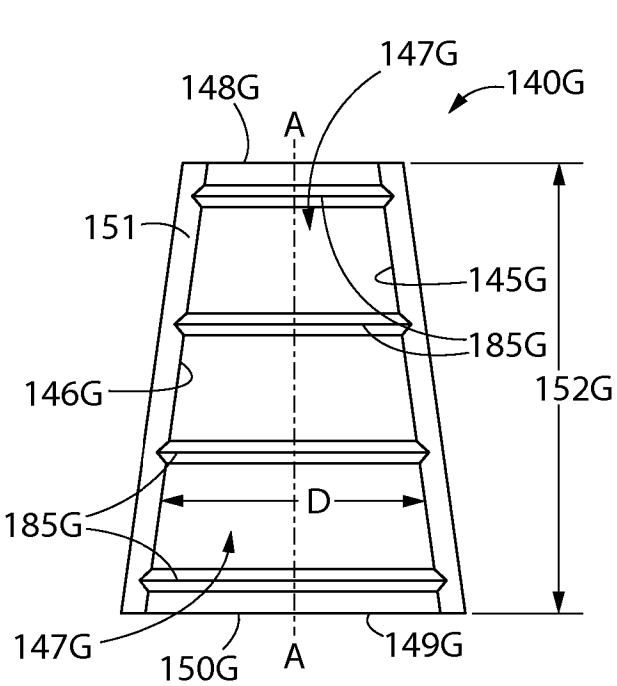
FIG. 20 is a top view of the pouring spout of the spout fitment of FIG. 18.
Figure 19:
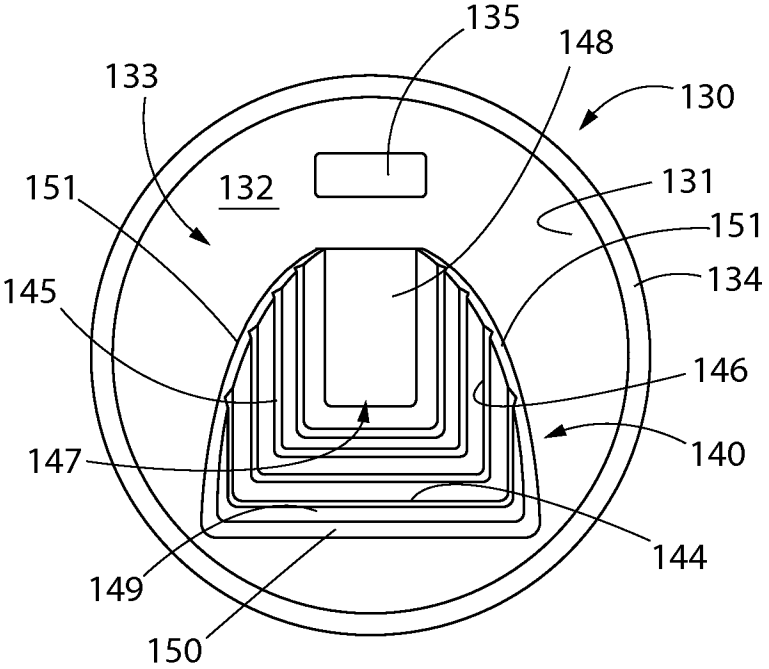
FIG. 19 is a front view of the spout fitment of FIG. 18.

Referring now to FIGS. 18-20 concurrently, a fourth embodiment of a spout fitment 130G that includes a pouring spout 140G including a topographical feature that may increase the amount of scent released during product dispensing is disclosed. In this embodiment, the topographical feature is in the form of a plurality of depressions, which are in the form of a plurality of transversely extending grooves 185G. The transversely extending grooves 185G, in the exemplified embodiment, extend substantially perpendicular to the longitudinal axis A-A. In other embodiments, however, the transversely extending grooves 185G may extend obliquely to the longitudinal axis A-A.

The transversely extending grooves 185G are longitudinally spaced apart from one another along the pouring spout 140G. The transversely extending grooves 185G are substantially parallel to one another in the exemplified embodiment, but may be arranged in non-parallel arrangements in other embodiments.

In the exemplified embodiment, the transversely extending grooves 185G are formed in and extend continuously across each of the floor surface 144G, the first side surface 145G, and the second side surface 146G. Thus, each of the first and second side surfaces 145G, 146G and the floor surface 144G can be considered to comprises a plurality of transversely extending grooves 185G. In other embodiments, the plurality of transversely extending grooves 185G may be omitted from the first and second side surfaces 145G, 146G such that only the floor surface 144G may comprise the plurality of transversely extending grooves 185G, and vice versa.

The transversely extending grooves 185G are exemplified in the form of elongated V-shaped channels. In other embodiments, the transversely extending grooves 185G may have different sectional shapes, such as rectangular or semi-oval. In one particular embodiment, the transversely extending grooves 185G (and the peaks therebetween) may have cross-sectional shapes such that an undulating surface is formed, wherein the undulations take the form of a repetitive pattern of concave valleys and convex peaks. In one such specific embodiment, the undulations may take on a sinusoidal configuration so that the spout resembles a traditional washboard.

Additionally, while the transversely extending grooves 185G are exemplified as continuous trenches, the transversely extending grooves 185G may be segmented in other embodiments. The transversely extending grooves 185G are linear in the exemplified embodiment but may be nonlinear in other embodiments, such as curved, either convex and/or concave.

During a product dispensing event in which the spout fitment 130G is incorporated into the packaged product 1000, the transversely extending grooves 185G may cause waves or other irregularities and/or turbulences in the stream of the scented household product 200 flowing through the flow channel 147G. As a result, an increased amount of scent may be released from the scented household product 200 during the product dispensing event.

Figure 21:
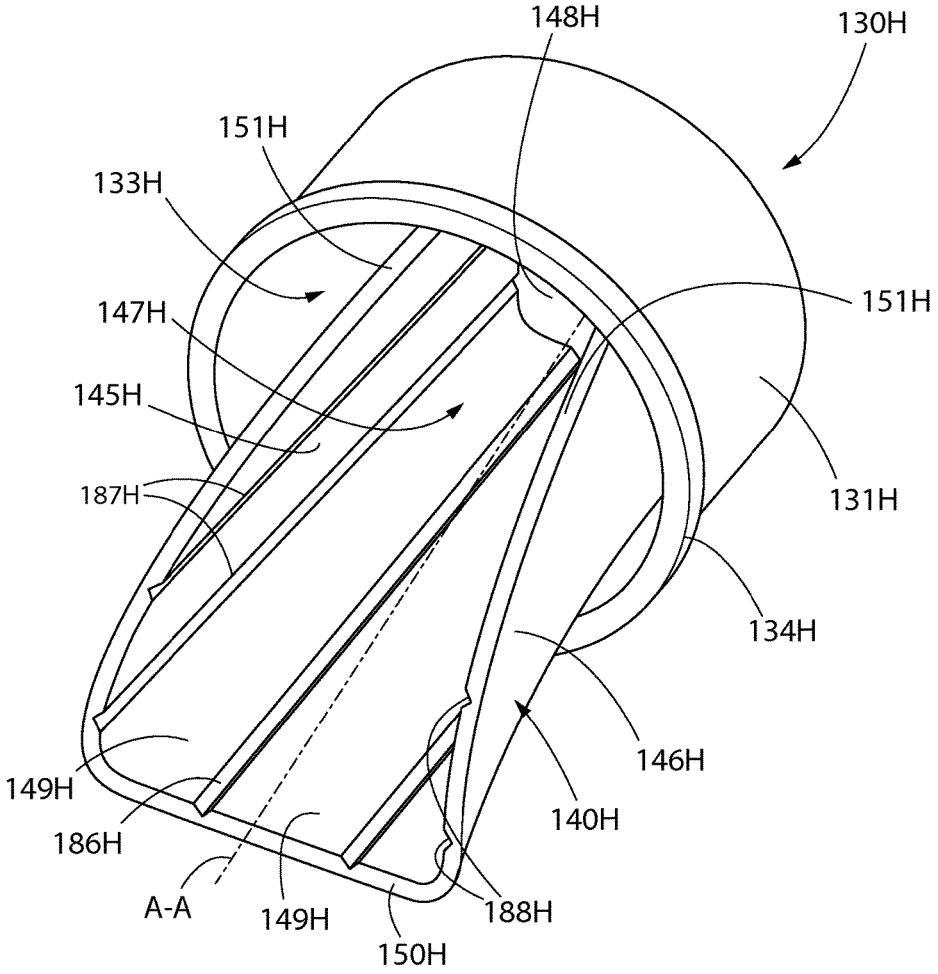
FIG. 21 is a perspective view of a fourth alternate embodiment of a spout fitment that can be incorporated into the container of the packaged product of FIG. 1 in accordance with the present invention, wherein the pouring spout includes a plurality of longitudinally extending grooves.
Figure 23:
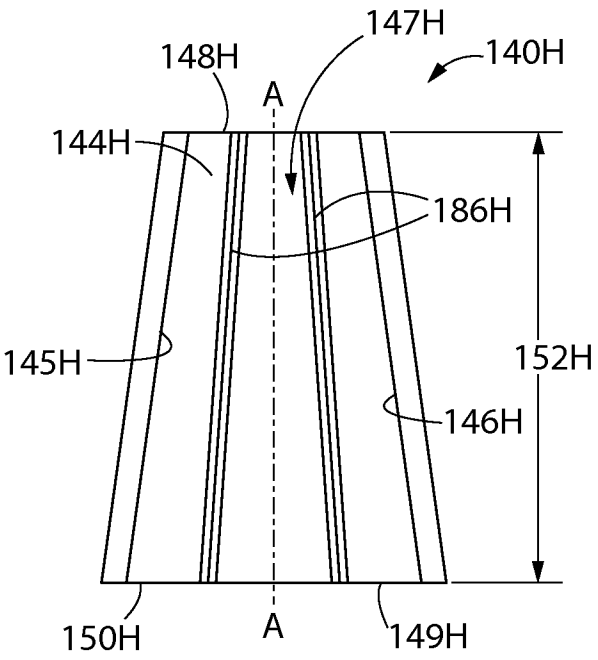
FIG. 23 is a top view of the pouring spout of the spout fitment of FIG. 21.
Figure 22:
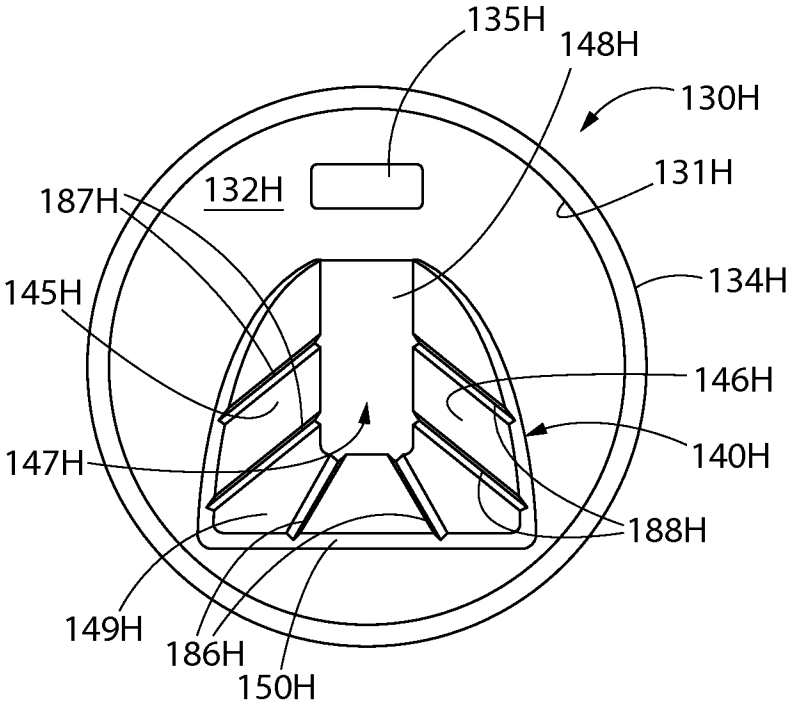
FIG. 22 is a front view of the spout fitment of FIG. 21.

Referring now to FIGS. 21-23 concurrently, a fifth embodiment of a spout fitment 130H that includes a pouring spout 140H including a topographical feature that may increase the amount of scent released during product dispensing is disclosed. In this embodiment, the topographical feature is in the form of a plurality of depressions, which are in the form of a plurality of longitudinally extending grooves 186H, 187H, 188H. In the exemplified embodiment, each of the plurality of longitudinally extending grooves 186H, 187H, 188H extend the entire length of the pouring spout 140H from the spout inlet 148H to the spout outlet 149H. In certain embodiments, one or more of the plurality of longitudinally extending grooves 186H, 187H, 188H may extend less than the entire length of the pouring spout 140H. The longitudinally extending grooves 186H, 187H, 188H are transversely spaced apart from one another.

The plurality of longitudinally extending grooves 186H are located along and formed into the floor surface 144H of the pouring spout 140H. The plurality of longitudinally extending grooves 186H are transversely spaced from another. The plurality of longitudinally extending grooves 186H diverge from one another with longitudinal distance from the spout inlet 148H. More specifically, the plurality of longitudinally extending grooves 186H diverge from one another along the flared section 152H of the flow channel 147H. Thus, the plurality of longitudinally extending grooves 186H may not only assist with creating waves and/or irregularities in the stream of the scented household liquid 200 during a product dispensing event, but may also assist with spreading/widening the stream of the scented household liquid 200 as it flows through the flared section 152H, thereby ensuring an increase in the exposed surface area of the scented household liquid 200. In certain embodiments, the plurality of longitudinally extending grooves 186H may be arranged symmetrically about the longitudinal axis A-A so as to intersect each other along the longitudinal axis A-A to form consecutively nesting V-shaped grooves. In other embodiments, however, the plurality of longitudinally extending grooves 186H may extend substantially parallel to one another and/or substantially parallel to the longitudinal axis A-A.

The plurality of longitudinally extending grooves 187H are located along and formed into the first side surface 145H of the pouring spout 140H. The plurality of longitudinally extending grooves 187H extend substantially parallel to one another in the exemplified embodiment, but may extend non-parallel to one another in other embodiments. The plurality of longitudinally extending grooves 188H are located along and formed into the second side surface 146H of the pouring spout 140H. The plurality of longitudinally extending grooves 188H extend substantially parallel to one another in the exemplified embodiment, but may extend non-parallel to one another in other embodiments.

The plurality of longitudinally extending grooves 187H, 188H may further assist with increasing the amount of scent released from the scented household liquid 200 during a product dispensing event by directing a portion of the flow of the scented household liquid 200 along the first and second side surfaces 145H, 146H. As a result, the scented household liquid 200 may coat the floor surface 144H, the first side surface 145H, and the second side surface 146H during a product dispensing event. The existence of the plurality of longitudinally extending grooves 187H, 188H along the first and second side surfaces 145H, 146H may be particularly useful in embodiments in which the plurality of longitudinally extending grooves 187H, 188H are located along a flared section 152H of the flow channel 147H. In such an embodiment, because the width D of the flow channel 147HH is narrowed at the entry point of the flared section 152H (compared to the remainder of the flared section 152H), the depth of the stream of the scented household product 200 will be elevated at the entry point, allowing the scented household product 200 to ride up along the first and second side surfaces 145H, 146H. As the scented household product 200 flows down the flared section 152H, widening out and becoming shallower, some of the scented household product 200 that rode up along the first and second side surfaces 145H, 146H will carried down the pouring spout 140H along the plurality of longitudinally extending grooves 187H, 188H.

In the exemplified embodiments, each of the floor surface 144H, the first side surface 145H, and the second side surface 146H comprise the longitudinally extending grooves 186H, 187H, 188H. In other embodiments, the plurality of longitudinally extending grooves 187H, 188H may be omitted from the first and second side surfaces 145H, 146H such that only the floor surface 144H may comprise the plurality of longitudinally extending grooves 186H. In other embodiments, the plurality of longitudinally extending grooves 186H may be omitted from the floor surface 144H such that only the first and second side surfaces 145H, 146H comprise the plurality of longitudinally extending grooves 187H, 188H.

The longitudinally extending grooves 186H, 187H, 188H are exemplified in the form of elongated V-shaped channels. In other embodiments, the longitudinally extending grooves 186H, 187H, 188H may have different sectional shapes, such as rectangular or semi-oval. In one particular embodiment, the longitudinally extending grooves 186H, 187H, 188H (and the peaks therebetween) may have cross-sectional shapes such that an undulating surface is formed, wherein the undulations take the form of a repetitive pattern of concave valleys and convex peaks. In one such specific embodiment, the undulations may take on a sinusoidal configuration.

Additionally, while the longitudinally extending grooves 186H, 187H, 188H are exemplified as continuous trenches, the longitudinally extending grooves 186H, 187H, 188H may be segmented in other embodiments. The longitudinally extending grooves 186H, 187H, 188H are linear in the exemplified embodiment but may be nonlinear in other embodiments, such as curved, either convex and/or concave.

Figure 24:
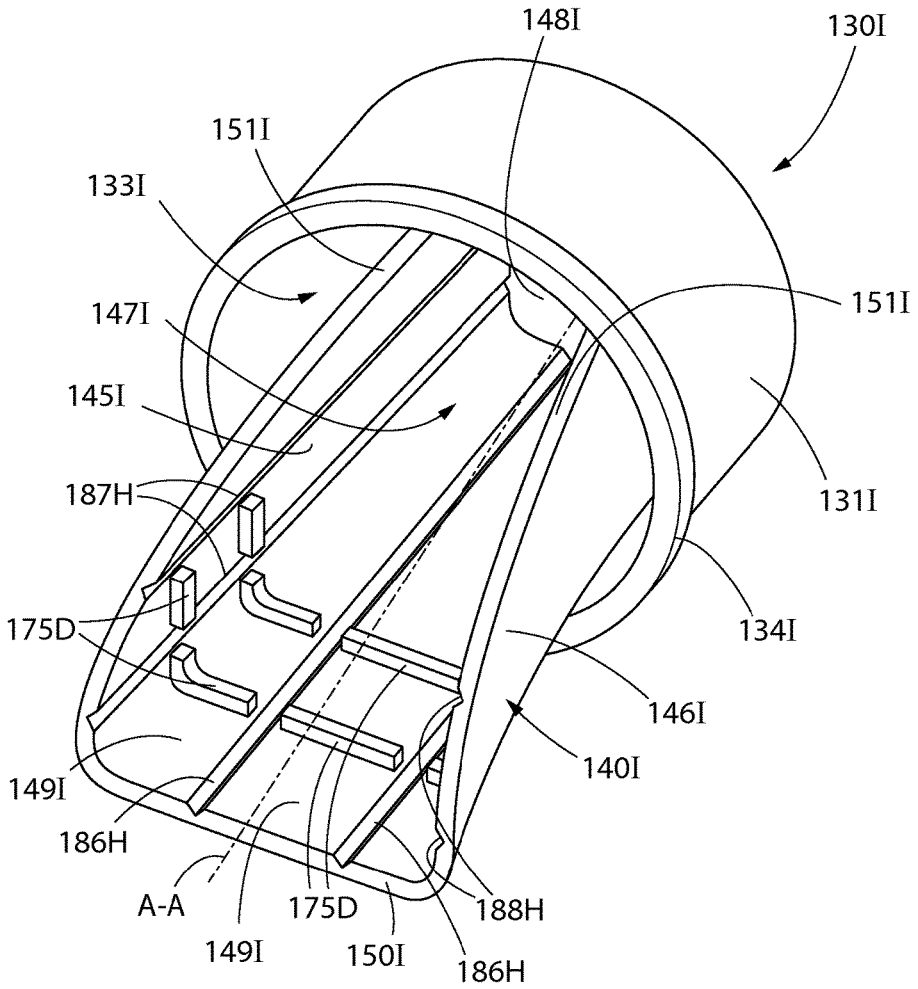
FIG. 24 is a perspective view of a fifth alternate embodiment of a spout fitment that can be incorporated into the container of the packaged product of FIG. 1 in accordance with the present invention, wherein the pouring spout includes a plurality of longitudinally extending grooves and a plurality of transversely extending ridges.
Figure 26:
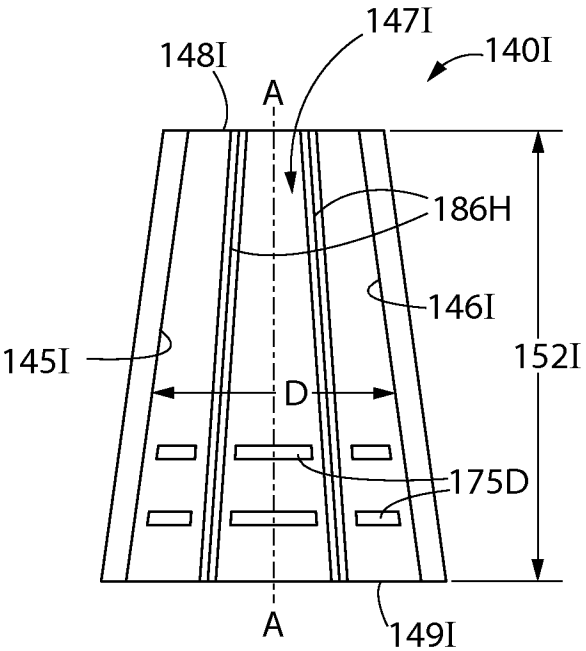
FIG. 26 is a top view of the pouring spout of the spout fitment of FIG. 24.
Figure 25:
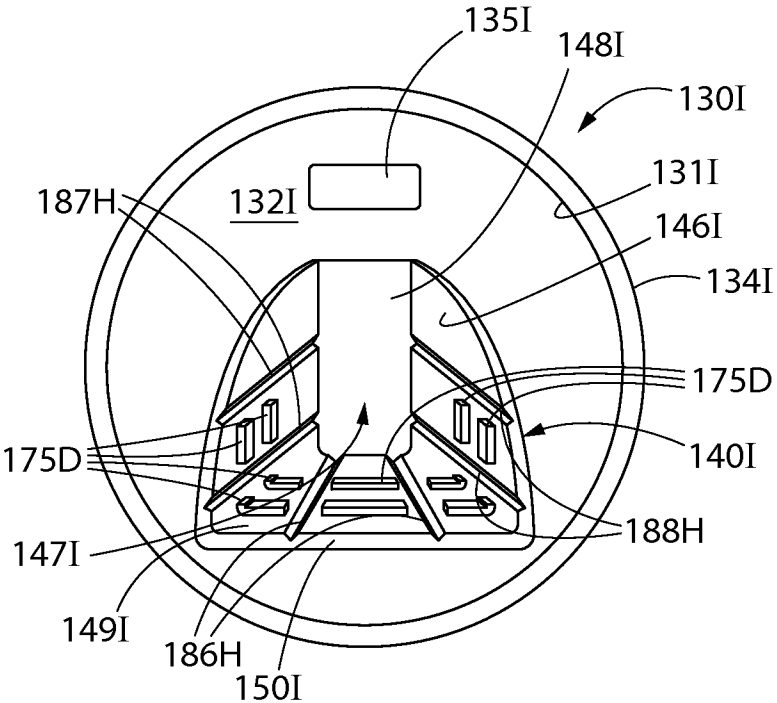
FIG. 25 is a front view of the spout fitment of FIG. 24.

Referring now to FIGS. 24-26 concurrently, a sixth embodiment of a spout fitment 130I that includes a pouring spout 140I including a topographical feature that may increase the amount of scent released during product dispensing is disclosed. In this embodiment, the topographical feature is in the form of a plurality of protuberances and a plurality of depressions. The plurality of protuberances are in the form of a plurality of transversely extending ridges 175D (discussed above in relation to FIGS. 9-11) and the plurality of depressions are in the form of a plurality of longitudinally extending grooves 186H, 187H, 188H (discussed above in relation to FIGS. 21-23). It is to be understood that the above discussions regarding the details of the plurality of transversely extending ridges 175D and the plurality of longitudinally extending grooves 186H, 187H, 188I are applicable to the exemplified embodiment of FIGS. 24-26.

The pouring spout 140I of the spout fitment 130I comprises both the plurality of transversely extending ridges 175D, which are in segmented form, and the plurality of longitudinally extending grooves 186H, 187H, 188H. Thus, the floor surface 144I comprises both the plurality of longitudinally extending grooves 186H and segments of the plurality of transversely extending ridges 175D (which can be considered transversely extending ridges). The first side surface 145I comprises both the plurality of longitudinally extending ridges 187H and segments of the plurality of transversely extending ridges 175D (which can be considered transversely extending ridges). The second side surface 146I comprises both the plurality of longitudinally extending grooves 188H and segments of the plurality of transversely extending ridges 175D (which can be considered transversely extending ridges).

The plurality of transversely extending ridges 175D are segmented such that the plurality of transversely extending ridges 175D do not intersect with any of the plurality of longitudinally extending grooves 186H, 187H, 188H. Rather, the plurality of transversely extending ridges 175D and the plurality of longitudinally extending grooves 186H, 187H, 188H to form a non-intersecting grid arrangement. In certain other embodiments, the plurality of transversely extending ridges 175D may intersect with the plurality of longitudinally extending grooves 186H, 187H, 188H to form an intersecting grid arrangement.

Figure 27:
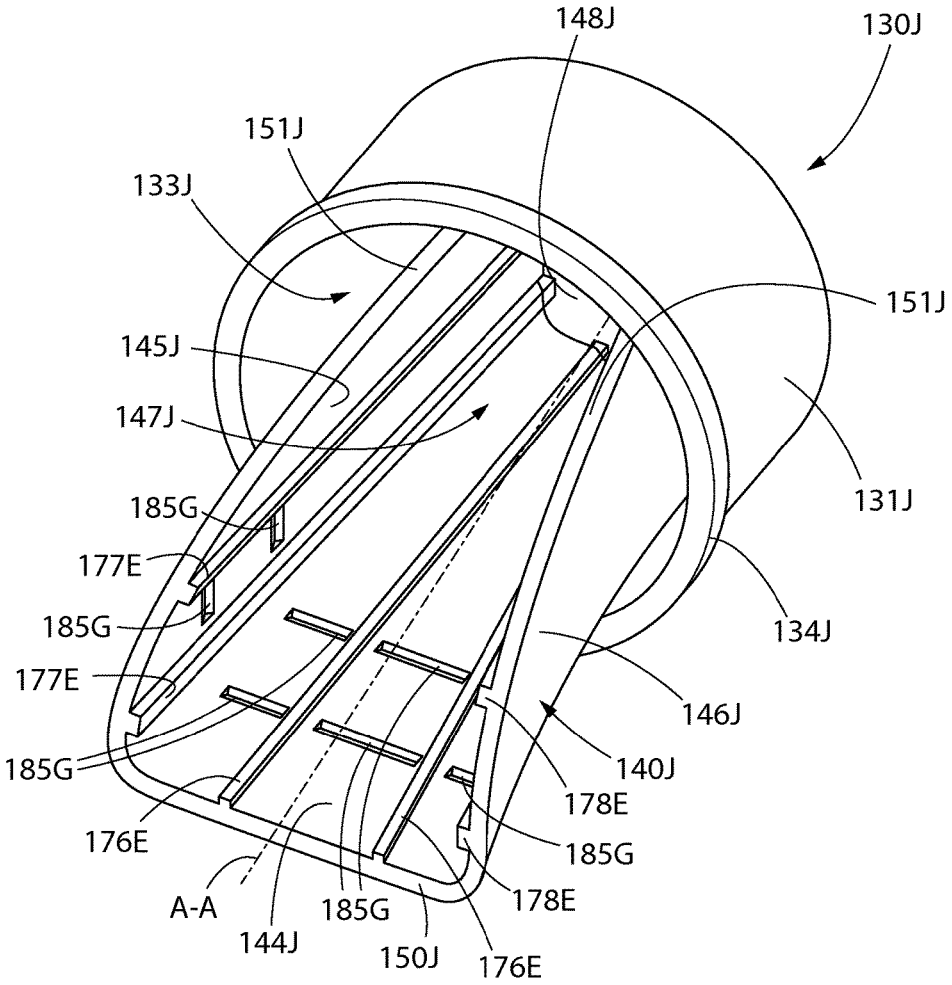
FIG. 27 is a perspective view of a sixth alternate embodiment of a spout fitment that can be incorporated into the container of the packaged product of FIG. 1 in accordance with the present invention, wherein the pouring spout includes a plurality of longitudinally extending ridges and a plurality of transversely extending grooves.
Figure 29:
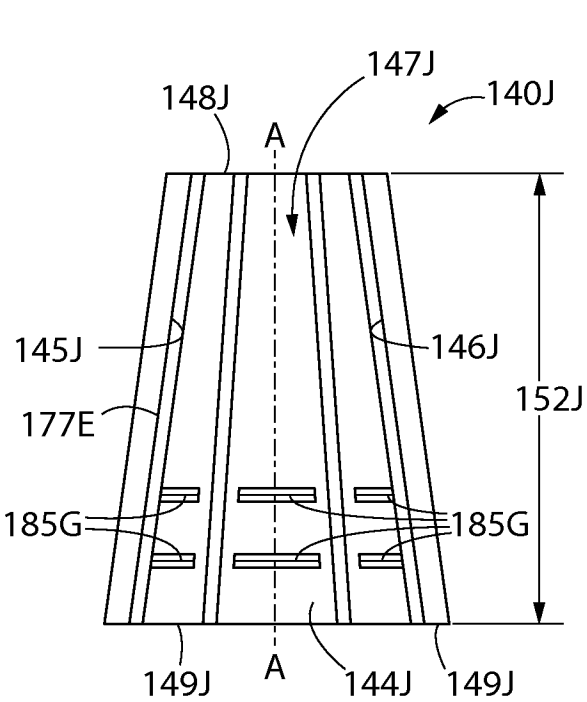
FIG. 29 is a top view of the pouring spout of the spout fitment of FIG. 27.
Figure 28:
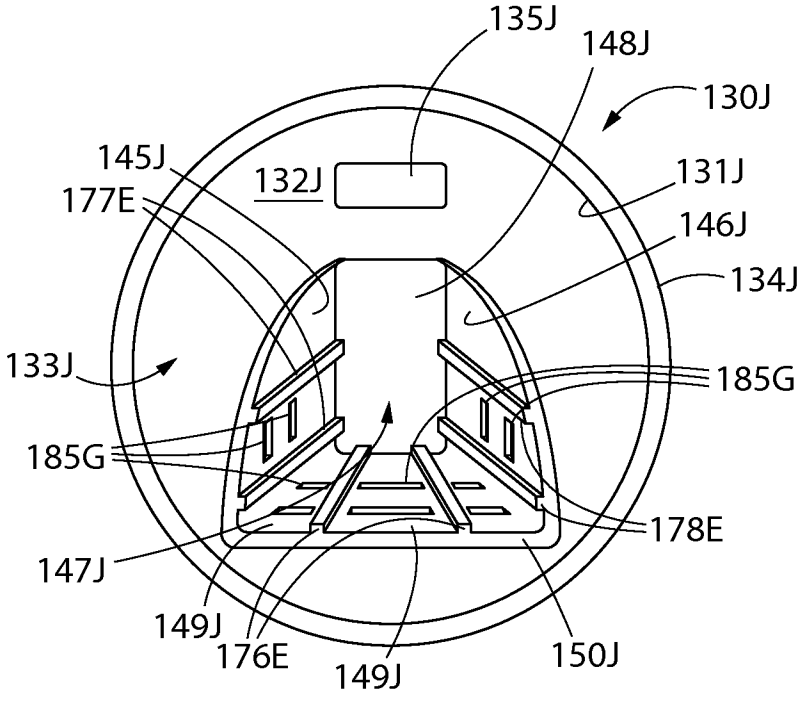
FIG. 28 is a front view of the spout fitment of FIG. 27.

Referring now to FIGS. 27-29 concurrently, a seventh embodiment of a spout fitment 130J that includes a pouring spout 140J including a topographical feature that may increase the amount of scent released during product dispensing is disclosed. In this embodiment, the topographical feature is in the form of a plurality of protuberances and a plurality of depressions. The plurality of protuberances are in the form of the plurality of longitudinally extending ridges 176E, 177E, 178E (discussed above in relation to FIGS. 12-14) and the plurality of depressions are in the form of the plurality of transversely extending grooves 185G (discussed above in relation to FIGS. 18-20). It is to be understood that the above discussions regarding the details of the plurality of longitudinally extending ridges 176E, 177E, 178E and the plurality of transversely extending grooves 185G are applicable to the exemplified embodiment of FIGS. 27-29.

The pouring spout 140J of the spout fitment 130J comprises both the plurality of longitudinally extending ridges 176E, 177E, 178E and the plurality of transversely extending grooves 185G (which are in segmented form). Thus, the floor surface 144J comprises both the plurality of longitudinally extending ridges 176E and segments of the plurality of transversely extending grooves 185G (which can be considered transversely extending grooves). The first side surface 145J comprises both the plurality of longitudinally extending ridges 177E and segments of the plurality of transversely extending grooves 185G (which can be considered transversely extending grooves). The second side surface 146J comprises both the plurality of longitudinally extending ridges 178E and segments of the plurality of transversely extending grooves 185G (which can be considered transversely extending grooves).

The plurality of transversely extending grooves 185G are segmented such that the plurality of transversely extending grooves 185G do not intersect with any of the plurality of longitudinally extending ridges 176E, 177E, 178E. Rather, the plurality of transversely extending grooves 185G and the plurality of longitudinally extending ridges 176E, 177E, 178E to form a non-intersecting grid arrangement. In certain other embodiments, the plurality of transversely extending grooves 185G may intersect with the plurality of longitudinally extending ridges 176E, 177E, 178E to form an intersecting grid arrangement.

As mentioned above, the exact structural manifestation and arrangement of the topographical feature(s) on the pouring spout to increase scent release can be varied widely in accordance with the present invention. For example, in one non-illustrated embodiment, the topographical feature may consist of a roughened surface comprising surface irregularities. In still another non-illustrated embodiment, both longitudinally extending grooves and longitudinally extending ridges may be combined.

While not shown, in some embodiments, a porous element may be included around the spout fitment 130. The porous element is suitable for retaining a quantity of the scented household liquid 200. The porous element captures, or becomes infused with, the scented household liquid 200 and its fragrance either by simple contact with the scented household liquid 200 or by capillary action as a result of coming into contact with the scented household liquid 200. A potential purchaser is thus able to determine accurately the fragrance of the scented household liquid 200 prior to purchasing the container 100. In addition, throughout the working lifetime of the container 100, i.e. while some of the scented household liquid 200 remains in the container 100 and a user repeatedly dispense some of the scented household liquid 200, the user is able to sniff the opening 114 to determine accurately the fragrance of the scented household liquid 200.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A packaged product comprising:

a container body forming a cavity containing a scented household liquid, the container body comprising a neck portion;

a spout fitment coupled to the neck portion of the container body, the spout fitment comprising a pouring spout;

the pouring spout comprising a flow channel for dispensing the scented liquid from the cavity, the flow channel extending along a longitudinal axis from a spout inlet to a spout outlet at a distal end of the pouring spout, wherein the pouring spout comprises a floor surface, a first side surface, and a second side surface that collectively define the flow channel, wherein each of the floor surface and first and second side surfaces are substantially planar, each of the floor surface, first side surface and second side surface lying in a different plane;

the flow channel comprising a flared section having a transverse width that increases with longitudinal distance from the spout inlet;

a cap detachably coupled to the container body to cover the pouring spout and seal the cavity; and a plurality of protuberances protruding from at least one of the floor surface, first side surface, and the second side surface of the pouring spout, and wherein the plurality of protuberances comprises at least one of plurality of longitudinally extending ridges and a plurality of transversely extending ridges, the plurality of longitudinally extending ridges diverge from one another with the longitudinal distance from the spout inlet.

2. The packaged product according to claim 1 wherein a transverse distance between the first and second side surfaces defines the transverse width of the flow channel.

3. The packaged product according to claim 2 wherein each of the first and second side surfaces terminate in an upper edge, the pouring spout being in the form of an open trough.

4. The packaged product according to claim 2 wherein said protuberances increase the surface area of the at least one of the floor surface, the first side surface, and the second side surface of the pouring spout.

5. The packaged product according to claim 2 further comprising a plurality of depressions formed in at least one of the floor surface, the first side surface, and the second side surface of the pouring spout.

6. The packaged product according to claim 5 wherein the plurality of depressions comprises at least one of a plurality of longitudinally extending grooves and a plurality of transversely extending grooves.

7. The packaged product according to claim 6 wherein the plurality of depressions comprises a plurality of longitudinally extending grooves that diverge from one another with the longitudinal distance from the spout inlet.

8. The packaged product according to claim 2 wherein each of the first and second side surfaces have a height that decreases with the longitudinal distance from the spout inlet.

9. The packaged product according to claim 2 wherein each of the first and second side surfaces extends substantially perpendicular to the floor surface.

10. The packaged product according to claim 5 wherein the flared section is at least partially located within the neck portion of the container body.

11. The packaged product according to claim 10 wherein the spout fitment further comprises: an annular wall engaging the neck portion of the container body; an end wall extending inward from a bottom of the annular wall; and the pouring spout extending upward from the end wall.

12. The packaged product according to claim 11 wherein an annular gap exists between the pouring spout and the annular wall; and a drain aperture that forms a passageway between the annular gap and the cavity.

13. The packaged product according to claim 5 wherein the neck portion comprises a top edge, the pouring spout having a first portion located within the neck portion and a second portion protruding beyond the top edge of the neck portion.

14. The packaged product according to claim 5 wherein the scented household liquid is selected from a group consisting of a laundry care liquid and a cleaning liquid.

15. The packaged product according to claim 5 wherein the container body further comprises an integrally formed handle.

16. The packaged product according to claim 5 wherein the pouring spot has a maximum width and the neck portion has an outer diameter, and wherein the maximum width of the pouring spout is less than or equal to the outer diameter of the neck portion.

17. The packaged product according to claim 5 wherein the pouring spot has a maximum width and the cap has an inner diameter, wherein the maximum width of the pouring spout is less than or equal to the inner diameter of the cap.

18. The packaged product according to claim 5 wherein the flared section comprises the spout outlet.

19. A packaged product comprising:

a container body forming a cavity containing a scented household liquid, the container body comprising a neck portion;

a spout fitment coupled to the neck portion of the container body, the spout fitment comprising a pouring spout;

the pouring spout comprising a flow channel for dispensing the scented liquid from the cavity, the flow channel extending along a longitudinal axis from a spout inlet to a spout outlet at a distal end of the pouring spout, wherein the pouring spout comprises a floor surface, a first side surface, and a second side surface that collectively define the flow channel, wherein each of the floor surface and first and second side surfaces are substantially planar, each of the floor surface, first side surface and second side surface lying in a different plane;

the flow channel comprising a flared section having a transverse width that increases with longitudinal distance from the spout inlet;

a cap detachably coupled to the container body to cover the pouring spout and seal the cavity;

a plurality of protuberances protruding from at least one of the floor surface, first side surface, and the second side surface of the pouring spout; and a plurality of depressions formed in at least one of the floor surface, the first side surface, and the second side surface of the pouring spout, the plurality of depressions comprises at least one of a plurality of longitudinally extending grooves and a plurality of transversely extending grooves, the plurality of longitudinally extending grooves that diverge from one another with the longitudinal distance from the spout inlet.

* * * * *